US007162842B2

(12) United States Patent
Ribic

(10) Patent No.: US 7,162,842 B2
(45) Date of Patent: Jan. 16, 2007

(54) STRUCTURAL ELEMENT SYSTEM AND STRUCTURAL ELEMENTS OF SUCH SYSTEM FOR CURTAIN FACADES, FACADE LININGS, SUN ROOMS, SOUNDPROOFING WALLS, FAIR BUILDINGS AND THE LIKE

(76) Inventor: Walter Ribic, Hellerstr. 34, 44229, Dortmund (DE)

( * ) Notice: Subject to any disclaimer, the term of this patent is extended or adjusted under 35 U.S.C. 154(b) by 0 days.

(21) Appl. No.: 10/604,411

(22) Filed: Jul. 18, 2003

(65) Prior Publication Data

US 2005/0005543 A1 Jan. 13, 2005

Related U.S. Application Data

(63) Continuation of application No. PCT/DE02/00188, filed on Jan. 21, 2002, now abandoned.

(30) Foreign Application Priority Data

| | | |
|---|---|---|
| Jan. 19, 2001 | (DE) | 101 02 545 |
| May 14, 2001 | (DE) | 101 23 463 |
| Oct. 30, 2001 | (DE) | 101 53 088 |
| Dec. 16, 2001 | (DE) | 101 61 783 |

(51) Int. Cl.
*E04H 3/00* (2006.01)

(52) U.S. Cl. ..... 52/235; 52/772; 52/167.3

(58) Field of Classification Search ..... 52/235, 52/481.1, 483.1, 460, 464, 772, 770, 293.3, 52/DIG. 17, 167.3; 248/222.41, 222.13, 248/235, 244

See application file for complete search history.

(56) References Cited

U.S. PATENT DOCUMENTS

| | | | | |
|---|---|---|---|---|
| 3,055,460 A * | 9/1962 | Maroney | 52/293.3 |
| 4,648,231 A * | 3/1987 | Laroche | 52/775 |
| 5,170,602 A | 12/1992 | Ribic | |
| 5,632,125 A * | 5/1997 | Osanai | 52/235 |
| 6,718,708 B1 * | 4/2004 | Donoghue | 52/235 |

FOREIGN PATENT DOCUMENTS

| | | |
|---|---|---|
| DE | 30 48 152 | 6/1982 |
| DE | 42 03 316 | 6/1993 |
| DE | 196 16 490 | 10/1997 |
| EP | 0 191 145 | 8/1986 |
| EP | 0 399 778 | 11/1990 |
| EP | 0 586 320 | 3/1994 |
| EP | 0 599 264 | 6/1994 |
| EP | 1 020 579 | 7/2000 |
| EP | 1 033 453 | 9/2000 |
| GB | 2 078 837 | 1/1982 |

* cited by examiner

*Primary Examiner*—Basil Katcheves
(74) *Attorney, Agent, or Firm*—Gudrun E. Huckett

(57) ABSTRACT

A structural element system for the construction industry has post sections, framed flat elements, holding sections, and seals, wherein, for thermal insulation of the post sections and the framed flat elements, the holding sections are attached on the post sections, wherein the framed flat elements are attached to the holding sections, and wherein the seals together with the post sections form chambers. In the mounted state of the structural element system, the holding sections are enclosed in the chambers. The post section is a box section having at least one rectangular box for securing the holding sections, respectively, wherein the rectangular box has on two parallel outer sides at least two holding lips for securing the holding sections or a connecting member. The system can be used to erect curtain facades, facade linings, transparent roofs, sunrooms, soundproofing walls, fair buildings, carports and the like.

38 Claims, 19 Drawing Sheets

STRUCTURAL ELEMENT SYSTEM AND STRUCTURAL ELEMENTS OF SUCH SYSTEM FOR CURTAIN FACADES, FACADE LININGS, SUN ROOMS, SOUNDPROOFING WALLS, FAIR BUILDINGS AND THE LIKE

CROSS REFERENCE TO RELATED APPLICATIONS

This application is a continuation application of international application PCT/DE02/00188 with an international filing date of Jan. 21, 2002, not published in English according to PCT Article 21(2), and now abandoned.

BACKGROUND OF INVENTION

The invention relates to a structural element system and various structural elements of such a structural element system for the construction industry applicable for constructing curtain facades, facade linings, transparent roofs, sunrooms, soundproofing walls, fair buildings, carports and the like. In particular, the invention relates to a post section, a holding section, a fastening element, a connecting member, a rigid connecting element, a jointed connecting element, a multi-pad base member, a profiled strip, a seal, a frame section, and a two-pad profiled frame for frame flat elements for curtain facades, facade linings, transparent roofs, sunrooms, soundproofing walls, fair buildings (exhibition buildings, warehouses-type buildings), carports and the like.

Structural elements and structural element systems of the aforementioned kind enable a floating suspension, and thus an earthquake-safe mounting, of framed flat elements of all kinds, for example, of framed windowpanes, on post sections, and enable an easy-to-mount construction of facades and facade linings, transparent roofs, sunrooms, soundproofing walls, fair buildings or exhibition buildings, carports and the like. In particular, by means of such structural elements, aesthetically pleasing buildings and warehouses and the like can be constructed quickly and inexpensively, for example, when a steel frame is present on which the post sections can be fastened. The framed flat elements line do not simply line a facade but form themselves the facade and are floatingly mounted; such facades are referred to as "curtain facades". In the case of such a construction, the post sections are visible from the interior, i.e., from the room which is formed inside the flat elements, so that special requirements in regard to for aesthetic appearance are to be fulfilled by the construction system.

EP 0 447 508 B1 shows a structural element system of the aforementioned kind with framed flat elements, for example, which can mounted floatingly for covering a facade on post sections, wherein the frame of the flat elements is embodies as a two-part profiled frame.

DE 36 26 194 A1 shows a structural element system which, however, has technical as well as aesthetic disadvantages. For example, the frame parts which are visible from the interior are very wide and moreover separated by a visible gap from the actual post section. The frame sections which enclose, for example, two parallel windowpanes are difficult to manufacture which makes the structural element system expensive. This structural element system requires that between two framed flat elements positioned adjacently or on top one another seals must be inserted which, however, as a result of thermal expansion in the case of frame sections generally made of aluminum are exposed to great loads.

They are constantly compressed and expanded which results in the seals aging more quickly so that at some point in time they will fall out.

In addition, DE 195 26 671 A1 discloses, for example, for a similar application structural element systems for forming so-called post-and-latch constructions. However, they have the disadvantage in comparison to the above described systems that the flat elements must always be horizontally supported by the so-called latch and cannot be suspended in a floating arrangement. Such structural element systems are therefore not comparable to the systems of the aforementioned kind. In particular, mounting of the system of DE 195 26 671 A1 is very complex because the flat elements, i.e., in particular, two parallel windowpanes, are not pre-framed so that they cannot be simply suspended during assembly bust must be clamped on site.

A severe disadvantage, for aesthetic reasons, of such a post-and-latch construction is that first posts, which in the proper mounted state generally extend vertically, as well as second posts, which in the proper mounted state extends horizontally, are fully visible from the exterior of the facade while in the structural element system of the aforementioned kind the post elements are substantially fully covered by the framed flat elements and latches are entirety dispensed with; this has advantages in the so-called structural glazing (lining of the facade with glass) where the frame construction should be hardly visible in the finished facade.

In DE 299 15 574 U1, a structural element system is proposed in which however the framed flat elements are not suspended but are secured by screwing on corresponding post sections. This system has aesthetic as well as technical disadvantages. In particular, there are unpleasant transitional at the interior between a post section and a section positioned between the framed flat elements and the post section. Moreover, in this system the frame of the flat elements is problematic because generally the frame sections, which are extruded from aluminum, engage directly the flat elements so that, for example, aluminum and glass contact one another directly which can cause problems.

DE 88 11 937.8 U1 describes a structural element system in which however the flat elements are not framed. Instead, the flat elements, in general comprised of two parallel windowpanes, are suspended by a single adhesive connection. The outer one of the two windowpanes is provided with a bevel so that a conical holding element can pull the windowpane in the direction toward a post section. In this construction all elements are exposed to very high loads, in particular, as a result of thermal expansion of the air enclosed in double pane windows between the two windowpanes. Moreover, in this structural element system extremely minimal manufacturing tolerances must be observed because otherwise particularly the horizontal abutting areas between two flat elements arranged on top one another will not be completely sealed so that moisture can penetrate.

DE 35 40 385 describes a structural element system in which on the flat elements at the interior side a holding section is attached by gluing which however does not enclose the flat elements, i.e., the two windowpanes of a double pane window. Handling and mounting of such unframed windowpanes is a problem in particular when the flat elements must be quickly mounted outside. There is a greater risk of injury for the personnel. Moreover, the unframed flat elements can be easily damaged at their edge areas.

Widely accepted is the structural element system disclosed in EP 0 447 508 B1. However, this system has a problem with regard to thermal insulation because the structural elements are made of aluminum sections which conduct heat comparatively well and because the framed flat elements are suspended directly from the post sections.

A further problem is the attachment of the post sections on a wall to be covered or on a different support, for example, a base member or a steal beam. From post-and-latch constructions, fastening elements in the form of double-T sections are known which comprise a first leg resting against a wall or the like and secured thereat, for example, by screwing and two parallel legs which project perpendicularly from the first leg between which a post section can be attached by means of a fastening screw that is guided through the two legs and the post section. Depending on the construction situation, the fastening elements must always be positioned at different locations along the post section so that the post sections cannot be pre-drilled; it is therefore necessary to drill or mill holes for receiving the fastening screw into the post section on site. This increases the mounting expenditure on site significantly and makes assembly particularly at low ambient temperatures very difficult.

The post sections, which are generally vertical in the proper mounted state, are not only to be attached to the wall to be covered but also to the ground. The known base members for mounting on the ground must be aligned very exactly relative to one another before attachment of the post sections; this requires very precise and thus time-consuming measuring.

Often, two post sections must be connected directly with one another, in particular, such that a post section abuts like a latch laterally another post section but also such that both post sections abut one another in their longitudinal direction and, in this way, form practically a long, optionally angled, section. An example for this is a construction of a sunroom with pointed roof in which a vertically upwardly extending post passes into a slantedly upwardly extending roof beam.

A further problem of the known structural element systems is the framing of the flat elements by means of two-part profiled frames. In the known two-part profiled frames, the inner and outer frame sections or the frames formed of such sections, after insertion of the flat elements to be framed, i.e., two parallel windowpanes, are locked with one another so that the elements to be framed are clamped between the frame sections.

In this connection, those frame sections are referred to as outer frame sections which in the proper mounted state of the flat elements on a building face outwardly relative to the building while those frame sections which engage the side of the flat elements facing the interior of the building are referred to as inner frame elements. However, it should be mentioned in this connection that in many applications of the structural element systems according to the invention, for example, in connection with fair or exhibition buildings or for constructing partitions of closed rooms, the differentiation inner/outer cannot be easily made. As will be explained in connection with the drawing description, those frame sections referred to as outer frame sections engage in the mounted state the side of the framed flat elements facing away from the post sections, while those frame sections referred to as inner frame sections engage the side of the framed flat elements facing the post sections.

EP 0 447 508 B1 discloses to provide hooks on two parallel extending inner frame sections by which a framed flat element can be suspended from a post section.

This configuration has the result that in the case of a very strong suction action on the exterior of the building or a strong pressure action on the inner side of the building theoretically the outer frame section could be torn off its locking engagement on the inner frame section. Even though the disclosed inner and outer frame sections of EP 0 447 508 B1 are widely used and such tearing has not yet been reported, there is the desire to provide a profiled frame which, like the known frame, can also be manufactured and mounted simply and inexpensively, but which also makes impossible tearing apart of the inner and outer frame sections as a result of strong suction action on the exterior side of the framed flat elements, for example, as a result of a hurricane.

Also, the problem of the attachment of the post sections on the ground has not been solved in an visually satisfying way for every application situation. Also, the attachment of the post sections on the wall can still be improved, in particular, with respect to the alignment of different parallel extending post sections. Finally, there is the desire to provide a simple possibility to introduce and securely attach a transversely extending section between two post sections extending parallel in the mounted state.

The sections generally referred to in the structural element systems of the aforementioned kind as frame sections serve for framing and attaching elements, such as windowpanes, referred to generally as flat elements for the purpose of their attachment on a suitable construction for forming facade linings, transparent roofs, sunrooms, soundproofing walls, fair buildings, carports and the like. In particular, the frame sections are used for producing flat elements, where two flat elements that are rectangular in a plan view, in particular, two windowpanes, can be engaged and secured in a parallel position.

Even though such frame sections in general are used for framing and securing windowpanes, in particular, in the case of so-called structural glazing (covering of facades with glass), such frame sections can also be used for framing and securing other flat elements suitable for lining facades, for example, acrylic glass panes and other plastic material panes, stone plates, marble plates, and wood plates or metal plates.

Often there is the desire that in the case of a finished facade the frame of the respective flat elements should be hardly visible. The structural element system of the aforementioned kind should therefore include a frame section which in the mounted state is practically not visible. In the case of the framed flat elements, in particular, windowpanes, it is therefore the goal of the invention that as little as possible of the frame can be seen from the exterior.

SUMMARY OF INVENTION

It is an object of the present invention to provide a structural element system and its structural elements for curtain facades, facade linings, transparent roofs, sunrooms, soundproofing walls, fair buildings, carports, and the like which solve the aforementioned problems.

In accordance with the present invention, this is achieved in that, for a thermal separation of the post sections and framed flat elements, holding sections and seals are provided, wherein the holding sections are attached to the post sections, wherein the framed flat elements are attached to the holding sections, and the seals, together with the post sections, form chambers which enclose in the mounted state the holding sections.

According to the present invention, the heat transport via the sections is disrupted in that the framed flat elements, for example, windows, are not directly suspended from a post section but in that a seal of a hat-shaped cross-section and a holding section comprising one or several plastic stays with minimal heat conductivity is inserted between the post section and the flat elements. With such a so-called double-thermal separation it is prevented that the aluminum sections which engage the flat elements are in direct contact with a post section. Moreover, the post section is protected from direct contact with the ambient air.

It was found that the structural element system according to the invention can lower the manufacturing and assembly costs relative to known structural element systems by up to 70 percent. Even though the individual structural elements are partially more complex than the known structural elements, they can be produced, like most known structural elements, as extruded profiled sections so that their complex configuration is of no consequence. It is however important that the individual elements can be mounted particularly easily and quickly on site. The framed flat elements according to the invention are protected against damage during transport and can be mounted very quickly by simply suspending them.

DETAILED DESCRIPTION

In the following, several embodiments, which are only to be viewed as exemplary and not as limiting, of structural elements and of a structural element system according to the invention will be explained in connection with the drawings.

Figure 1A:
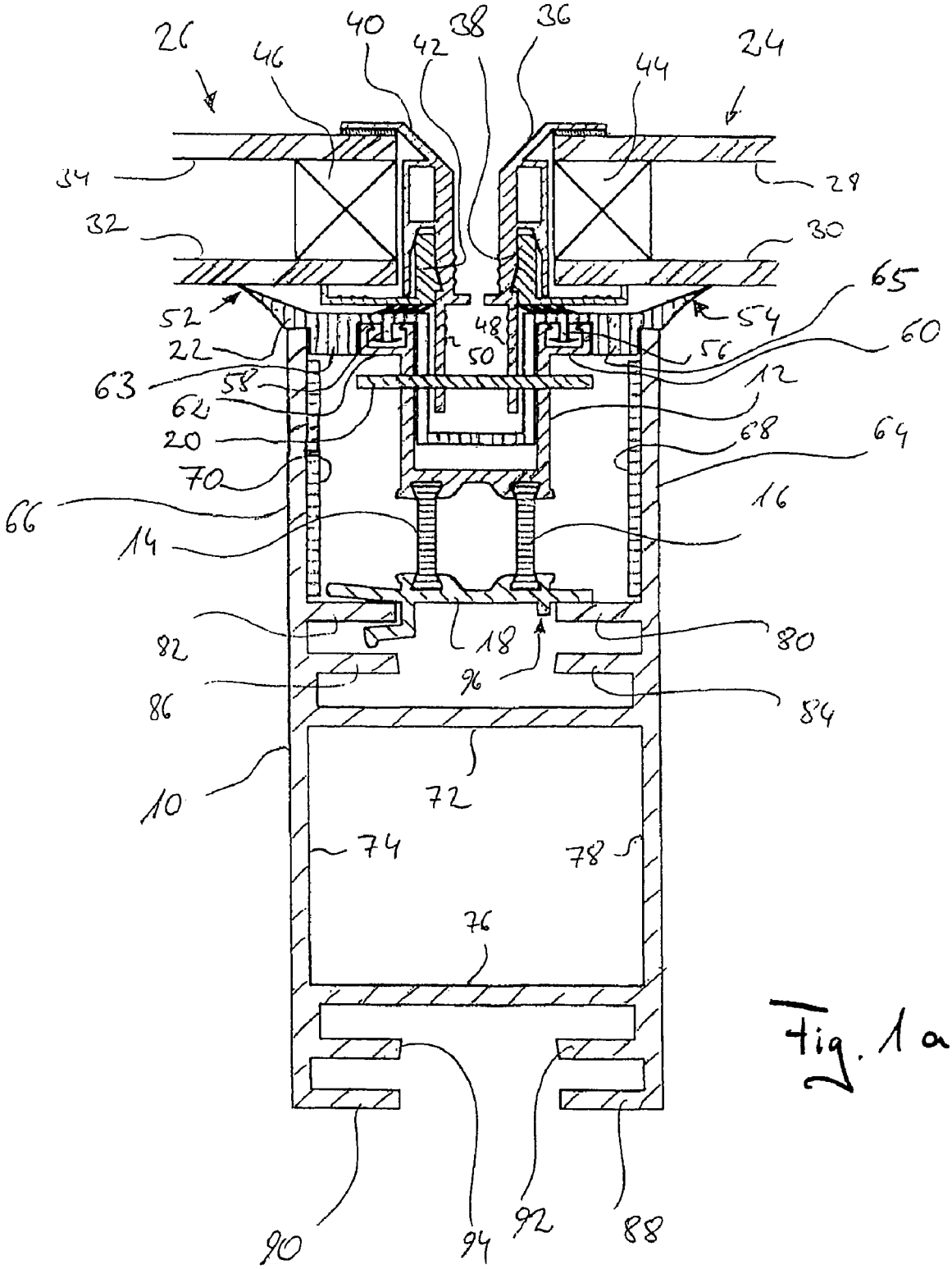
FIG. 1*a* is a cross-section of different structural elements of the system according to the invention in the mounted state, in particular, of a post section with inserted holding section from which two (only partially illustrated) framed flat elements, i.e., a double pane window, is suspended.
Figure 11:
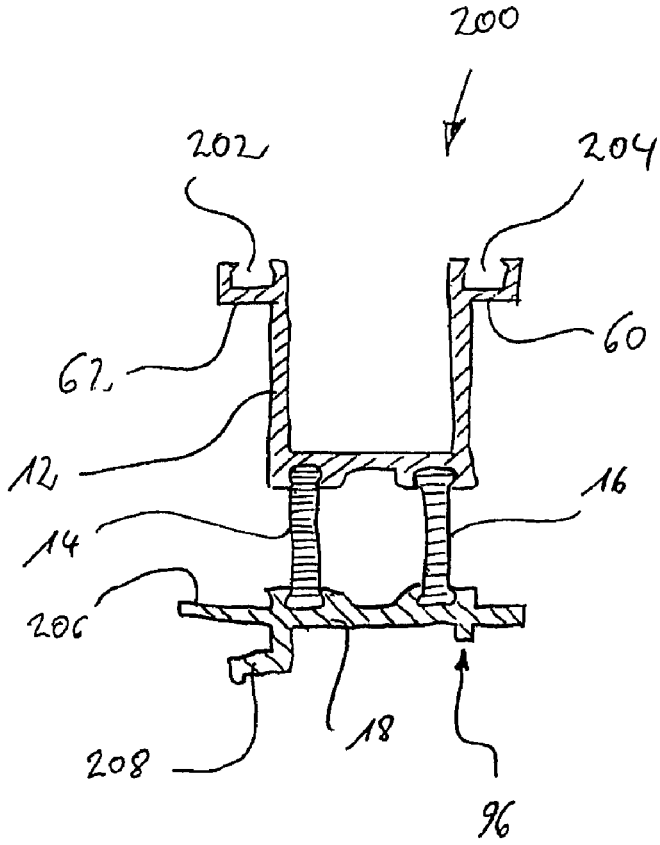
FIG. 11 shows the holding section according to FIG. 1 in cross-section.

FIG. 1*a* shows a cross-section of different components of the system according to the invention in the mounted state: a post section 10; a holding section comprised essentially of a U-shaped receptacle 12, two connecting stays 14 and 16, and a fastening part 18, wherein this profile is illustrated in the detail in FIG. 11; a securing bolt 20 extending through the receptacle 12; a seal 22 inserted into the receptacle 12; and two flat elements identified at 24 and 26.

In the illustrated embodiment, the framed flat elements 24 and 26 are double-pane windows with two windowpanes 28 and 30; 32 and 34 which are framed by interlocking inner frame sections 38, 42 and outer frame sections 36, 40. Between the two windowpanes 28 and 30; 32 and 34 of each flat elements 24 and 26, spacer elements 44 and 46 are provided which not only ensure the spacing of the respective windowpanes relative to one another but also effect of thermal separation (insulation) of the two windowpanes because they are comprised of material with minimal thermal conductivity.

The special feature of the two-part profiled frame comprised of the inner frame sections 38, 42 and the outer frame sections 36, 40 relative to the profiled frame of a two-part construction as disclosed in EP 0 447 508 B1 is that the outer frame sections 36 and 40 are configured for attachment of the framed flat elements 24 and 26 on the holding section (in the illustrated embodiment on the bolt 20 guided through the receptacle 12 of the holding section) so that, even in the case of great suction forces acting on the exterior side of the framed flat elements 24 and 26, i.e., on the outer windowpanes 28 and 34, or pressure forces acting on the inner side of one of the framed flat elements 24 and 26 defining the interior space onto the flat elements in the form of pressure forces as they can result, when a person inside the room pushes against the glass panes 30 and 32, a tearing apart of the interlocked inner and outer frame sections 38 and 36; 42 and 40 is reliably prevented because the aforementioned suction and pressure forces do not act on the interlocking arrangements.

The section illustrated in FIG. 1*a* is extended precisely through the bolt 20 which serves for suspending the framed flat elements 24 and 26 on the holding section comprised of the receptacle 12, connecting stays 14 and 16, and fastening part 18. The framed flat elements 24 and 26 are simply suspended from the bolt 20 wherein the legs 48 or 50 of the outer frame sections 36 or 40 are provided with corresponding hooks or receiving openings. This type of attachment of the framed flat elements enables not only a particularly fast and simple assembly but also has the advantage that the individual flat elements are suspended floatingly, which increases the stability of the resulting construction with regard to earthquakes significantly. Moreover, in this way individual flat elements can be easily exchanged as needed.

Figure 10:
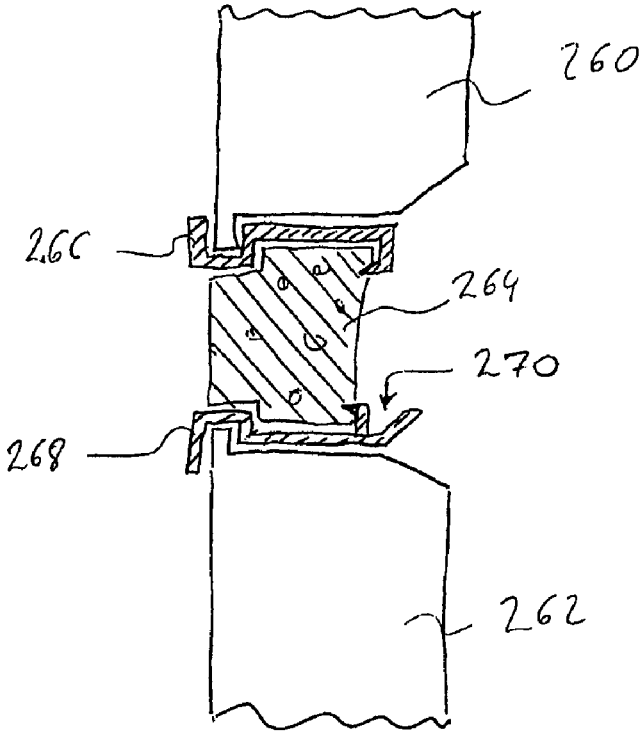
FIG. 10 shows a section of two frames flat elements which are only partially illustrated with a three-part seal arranged between them.

In order to prevent that the flat elements suspended above one another along a post section 10 become detached accidentally, between two flat elements suspended above another, for example, an elastic seal can be provided as illustrated in FIG. 10. The seal can be secured by means of two separate profiled strips wherein on one of the profiled strips a preferably slightly slanted groove for draining water toward the post sections can be formed.

Between the framed flat elements 24 and 26, on one side, and the receptacle 12 and the post section 10, on the other side, a seal 22 is provided which in cross-section resembles the cross-section of a hat. The seal 22 is provided with two sealing lips 52 and 54 which in the mounted state rest sealingly against one side of the framed flat elements 24 and 26, respectively. In the illustrated embodiment they rest against one side of the windowpanes 30 and 32, respectively.

The seal also has two securing portions 56 and 58 which are inserted into one of two undercut receiving channels, respectively, provided on the receptacle 12 of the holding section by means of the L-shaped portions 60 and 62 of the receptacle.

It should be noted that the seal 22 is configured such that it supports the receptacle 12 on the two legs 64 and 66 of the post section 10 in that it engages with the support beams 63 and 65 provided on the side of the sealing lips 52 and 54 facing away from the windowpanes the gaps formed the outer sides of the L-.shaped portions 60 and 62 facing the inner sides of legs 64 and 66 of the post section and the inner sides of the legs 64 and 66 of the post section 10.

A further special feature of the seal are the sealing lips which rest in the mounted state against the inner frame sections 38 or 42 of the framed flat elements 24 and 26.

In the drawing, they are not provided with reference numerals in order to simplify the drawing; they are located in the drawing above the securing portions 56 and 58 of the seal 22.

The parallel legs 64 and 66 formed on the post section 10 enclose the holding section at least partially and cover it so that the holding section is not visible from the interior of a room which is enclosed by using the post sections 10 and the framed flat elements 24 and 26.

The two legs 64 and 66 contribute further to thermal insulation because they prevent that hot room air can easily come into contact with the holding section, in particular, with the receptacle 12 of the holding section. It should be noted in this context that as a result of the configuration of the structural element system already the receptacle 12 is substantially thermally insulated by the seal 22; a contribution in this connection is provided by the suspension according to the invention of the framed flat elements 24 and 26 on the bolt 20 against which the seal 22 rests tightly.

The receptacle 12 does not have direct contact with the post section 10. The fastening part 18, which is in direct contact with the post section 10, is thermally separated from the receptacle 12 by means of the stays 14 and 16 comprised of material with low thermal conductivity.

A further insulation effect is achieved by the strips 68 and 70 of thermally insulating material, for example, sponge rubber, chloroprene, cork etc., attached to the inner sides of the legs 64 and 66 facing the holding section.

The post section 10 moreover is provided with a rectangular box, also referred to as chamber so that the post sections of the instant kind are also referred to as a hollowed chamber sections. The box is formed of profiled strips 72, 74, 76, 78 and provides high bearing capacity of th section while ensuring at the same time torsional stiffness. On two opposed outer sides of the box, holding lips 80, 82, 84, 86, 88, 90, 92, 94 are formed wherein two holding lips 80 and 82; 84 and 86; 88 and 90; as well as 92 and 94 form a pair of holding lips, respectively.

The holding lips contribute, on the one hand, to the strength of the post section 10 and enable, on the other hand, receiving and attachment of different other structural elements of the structural element system on the post section 10, for example, of the fastening part 18 of the holding section, wherein the holding section 18 in the illustrated embodiment has a substantially U-shaped section which encloses the holding lips 82 partially and has a projection 96 by which the fastening part 18 can be supported on the holding lip 80 positioned opposite the holding lip 82 of the holding section 10.

Figure 1B:
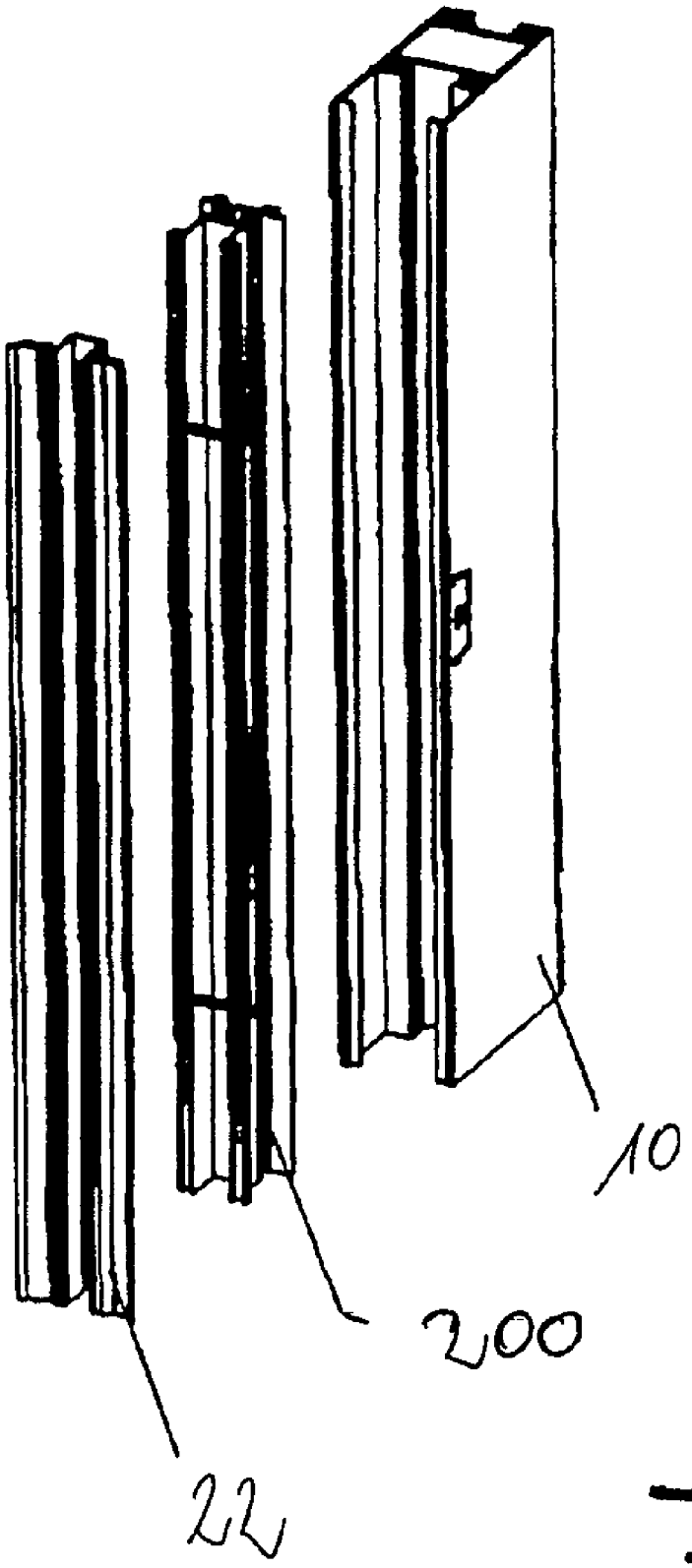
FIG. 1*b* shows a perspective exploded view of short sections of three usually significantly longer structural elements of the system, in particular, of the seal having in cross-section a hat shape, of the holding section, and of the post section.
Figure 1C:
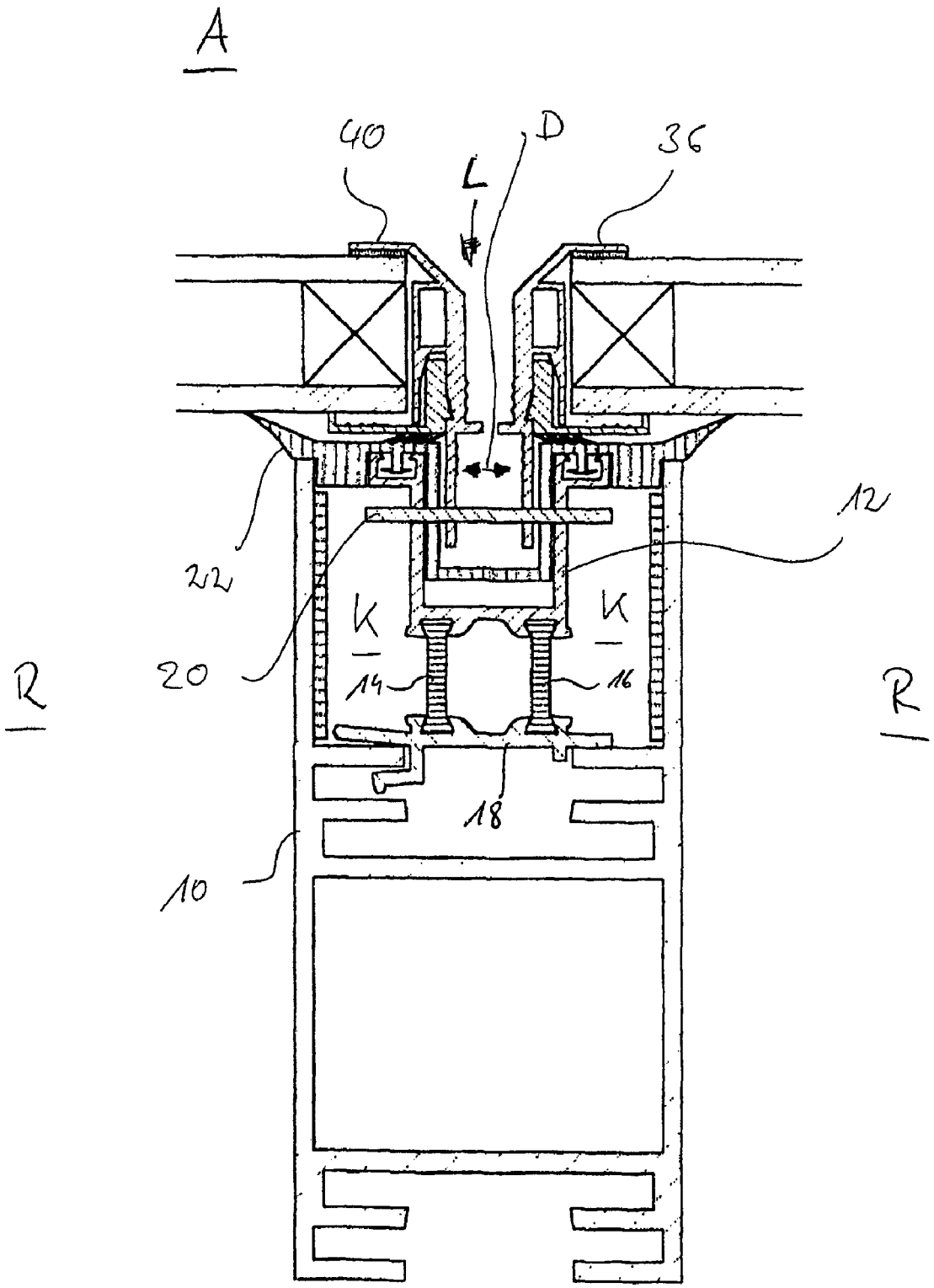
FIG. 1*c* corresponds to FIG. 1*a* and is provided for illustrating different problem zones in the structural element system of the aforementioned kind and for illustrating different advantages of the solution according to the invention.

FIG. 1*c* illustrates the advantages of the system according to the invention in more detail. Cold temperatures at the outer side A of a room R constructed with the inventive system cool the outer frame section 36 and 40 greatly. Cold air penetrates into the gap between the two outer frame sections. The outer frame sections however have no direct contact with the receptacle 12 of the holding section and also not with the post section 10. The only heat-conducting bridge between the frame sections and the holding section is provided by the holding bolts 20 which are positioned at a relatively great spacing to one another and have only a small contact surface with the air, the frame sections, and the holding section, so that in practice they do not cause any heat loss, in particular, because the holding section in itself is insulated by means of the seal 22 and is therefore thermally insulated. The receptacle 12 of the holding section is connected only by the insulating stays 14 and 16 to the fastening part 18 which is in contact with the post section 10. Post section 10 and seal 22 form between them a chamber K. in which the holding section is enclosed; this contributes to the extremely high thermal insulation of the system.

Two further advantages of the system according to the invention relative to other systems can be seen directly in FIG. 1*c*. Between the flat elements which are only suspended, a gap D is formed which serves as an expansion compensation and which allows the flat elements to freely expand upon heat exposure within the ranged of usual thermal expansion. Viewed from the room R, only the flat elements themselves, the post section 10, and in the transition areas of the post section and the inner flat elements only a narrow strip of the seal 22 is visible; this also satisfies the requirements with regard to an aesthetically pleasing appearance.

Figure 2:
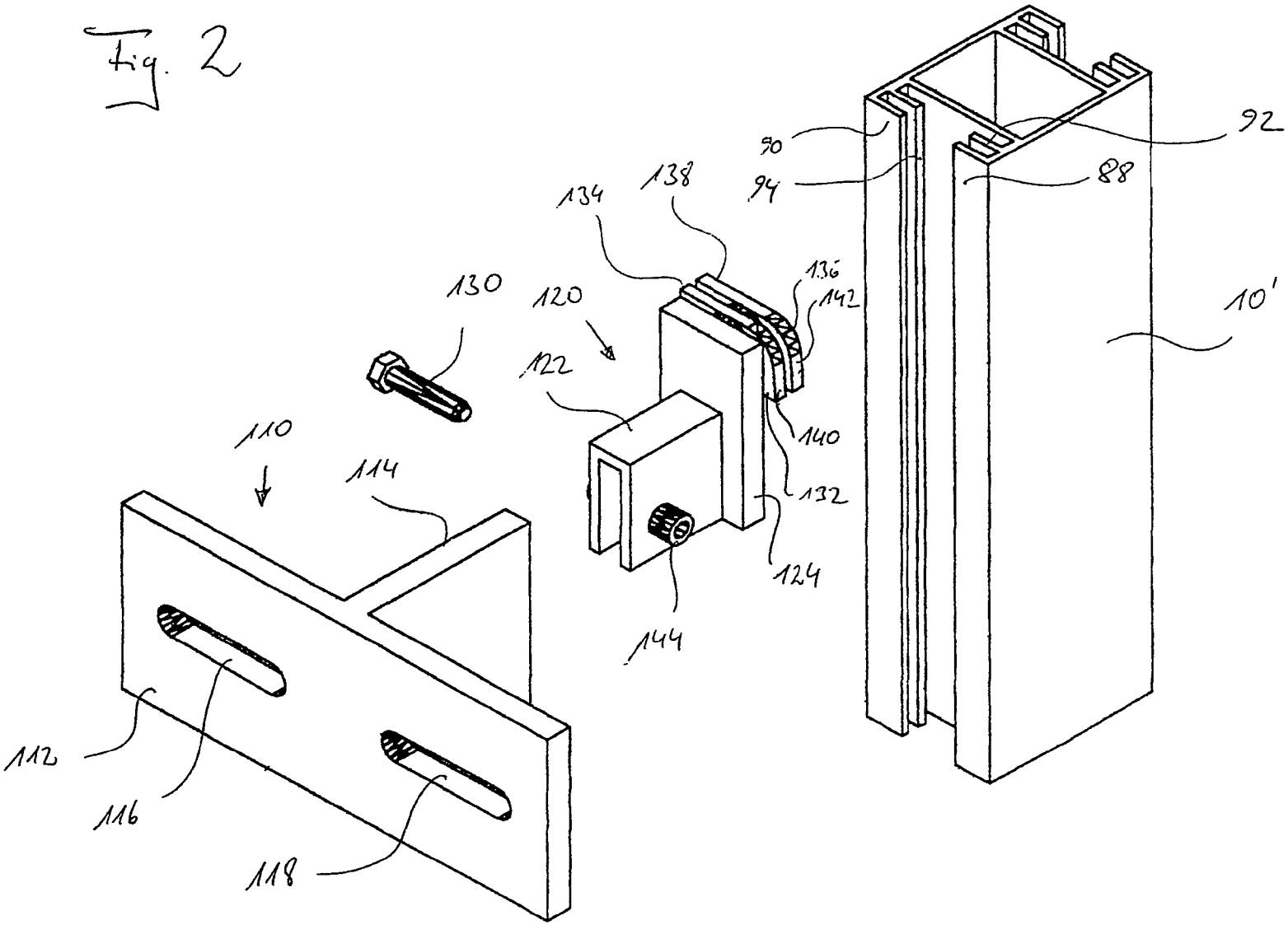
FIG. 2 is a perspective illustration of the individual elements for attaching a post section to a wall, a support or the like, in particular, an fastening element, a connecting member, a post section, and a securing screw.

FIG. 2 shows a post section 10' which corresponds substantially to the post section 10 according to FIG. 1 and differs from it only in that the two legs 64 and 66 are missing. Therefore, same parts of both post sections acting the same way, in particular, the holding lips 88, 90, 92, 94, are provided with the same reference numerals.

For attachment of the post section 10', for example, on a wall (not illustrated), a fastening element 110, a connecting member 120, and a securing screw 130 are provided.

The fastening element 120 in the illustrated embodiment is essentially T-shaped and has a contact leg 112 and a support leg 114 projecting at a right angle relative to the contact leg 112 for supporting the connecting member 120. The contact leg 112 and the support leg 114 in this embodiment are in a fixed position relative to one another.

The contact leg serves for attachment of the fastening elements on a support surface such as a wall, a base member, a carrier (beam) or the like, and has two slotted holes 116 and 118 for receiving fastening screws.

The connecting member 120 has a saddle section 122 that can be placed onto the support leg 114 of the fastening element 110 and a locking portion 124 which has four wings 132, 134, 136, and 138 for engaging from behind the holding lips 80, 90, 92, and 94 of the section 10' to be fastened.

For connecting the connecting member 120 and the post section 10', the wings 132, 134, 136, and 138 can also be pushed through the gaps formed between the pairs of holding lips 88 and 90 or 92 and 94 of the post section 10' and can be moved by rotation of the connecting member 120 relative to the post section 10' into a position behind the holding lips 88, 90, 92, 94. In this connection, the stop surfaces 140 and 142 provided on each wing delimit the rotation of the connecting member 120 and of the profile 10' to be attached thereto.

For attachment of the connecting member 120 on the fastening element 110, the saddle section 122 of the connecting member is placed onto the contact leg 114 of the fastening element 110 and secured by the securing screw 130 wherein on the outer side of the saddle section 122 a nut 144 matching the screw 130can be provided. When the securing screw is of the self-cutting kind, the contact leg 114 must not be pilot-drilled and, advantageously, a greater range for alignment of connecting member 120 and fastening element 110 relative to one another is available.

It should be noted that the securing screw 130 in this configuration of the connection of connecting member 120 and fastening element 110 is advantageously not a load-bearing one. It should be noted that, of course, other connecting possibilities of connecting member 120 and fastening element 110 are possible where the securing screw 130 is relieved of load bearing functions, for example, by configuring a corresponding receptacle on the fastening element into which a corresponding support leg of a connecting element can be inserted.

Figure 3:
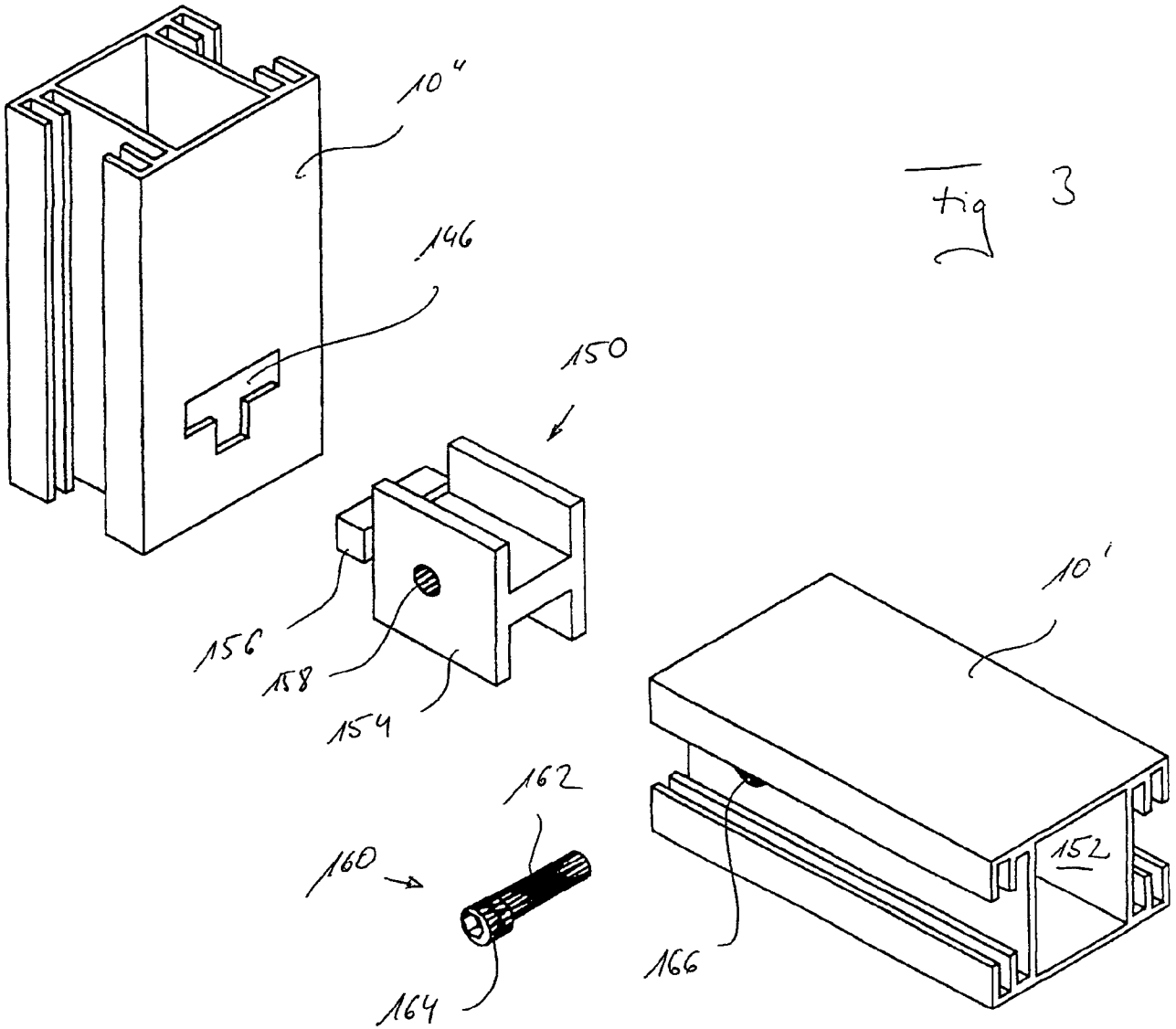
FIG. 3 is a perspective illustration of different elements for attaching two post sections to one another, in particular, a first post section with a T-shaped recess for suspending a connecting element, a rigid connecting element, a second post section, as well as an eccentric bolt for fixation of the second post section on the connecting element.

FIG. 3 shows two post sections 10' and 10" which corresponds substantially to the already described post sections. The special feature of the post section 10" is a T-shaped recess 146 which serves for suspending a connecting element 150.

The connecting element 150 serves for connecting the two post sections 10' and 10" and has an insertion section 154 which is insertable into the hollow chamber 152 of the post section 10' and is shaped substantially complementary to cross-section of the hollow chamber 152 of the post section 10', here in the shape of an H. The connecting element 150 has also a section 156 to be suspended from the other post section 10".

The insertion section 154 is provided with a receiving bore 158 for receiving an eccentric fastener in the form of an eccentric bolt 160, more precisely, for the cylindrical guide section 162 of the eccentric bolt 160.

The eccentric bolt 160 has in addition to the cylindrical guide section 162 a preferably conical eccentric section 164, which is however illustrated in the drawing as a cylindrical section.

After suspension of the section 156 of the connecting element 150 into the receptacle 146 of the post section 10" and the insertion of the insertion section 154 of connecting element 150 into the chamber 152 of the post section 10', the eccentric bolt serves for pressing and clamping the post section 10', the connecting element 150, and the post section 10" against one another: For this purpose, the bolt is inserted into the receptacle 158 of the connecting element 150 through a bore 166, provided in the post section 10' and having a diameter that is greater than the maximal diameter of the eccentric section 164, and subsequently rotated.

Figure 4:
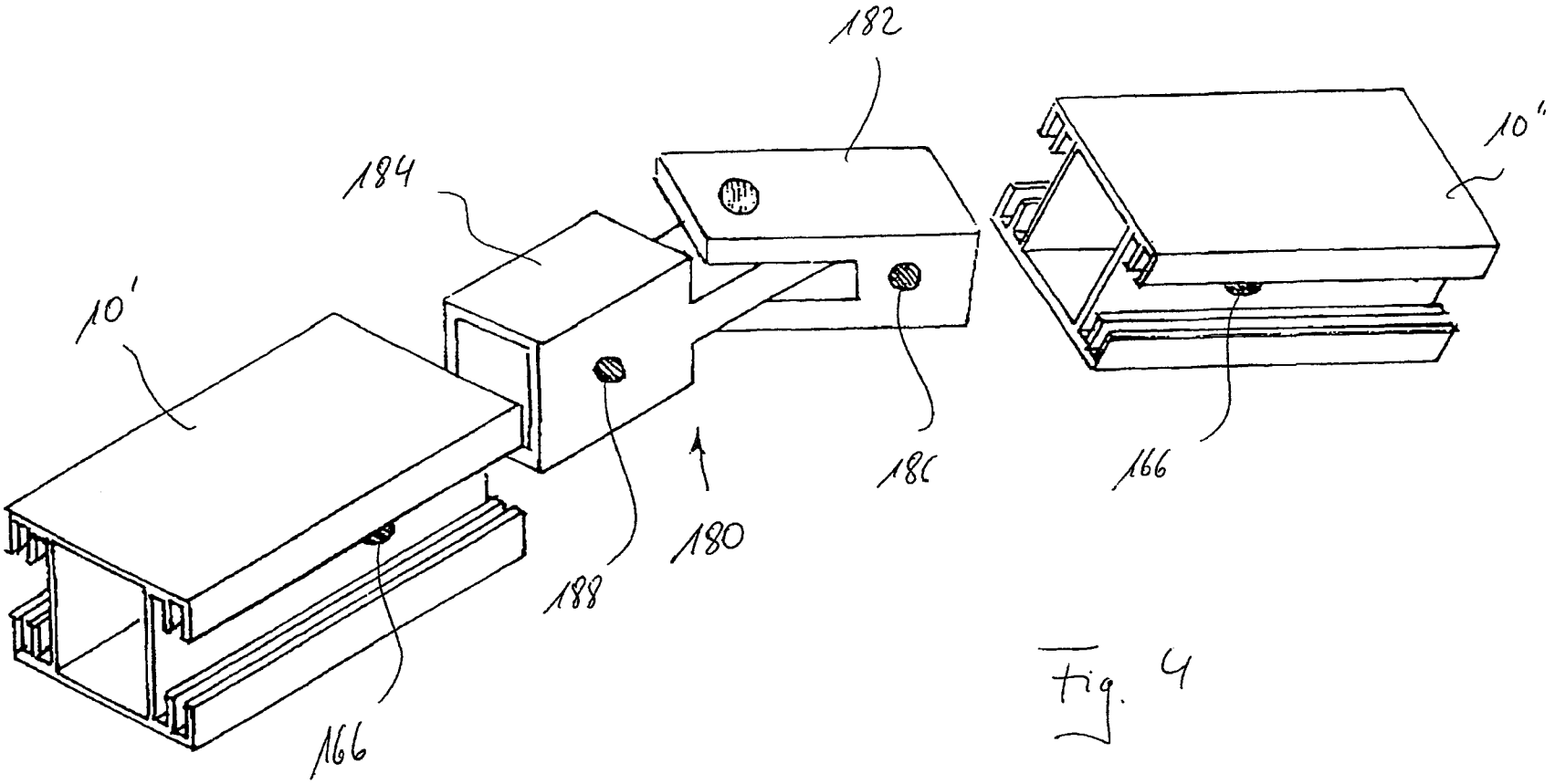
FIG. 4 is a perspective illustration of two post sections and a connecting element provided with a joint for connecting the two post sections.

FIG. 4 shows two post sections 10' and a connecting element 180 provided with a joint for connecting the two post sections.

The connecting element 180 enables advantageously to connect post sections that are miter-cut at any desired angle wherein it must be taken into account that in the drawing it can hardly be seen that the sections 10' have been miter-cut. The great advantage of the connecting element 180 is that a single connecting element can be used for any desired miter angle while in the prior art structural element systems it is necessary to provide connecting elements with a matching angle.

The connecting element 180 is comprised of two insertion sections 182 and 184 which are connected to one another by a joint and are insertable into the post sections 10' where they can be secured, for example, in the way described in connection with FIG. 3, by means of eccentric bolts. For this purpose, the insertion sections 182 and 184 are provided with receiving bores 186 and 188 and the post sections 10' have bores 166 are provided.

Figure 5:
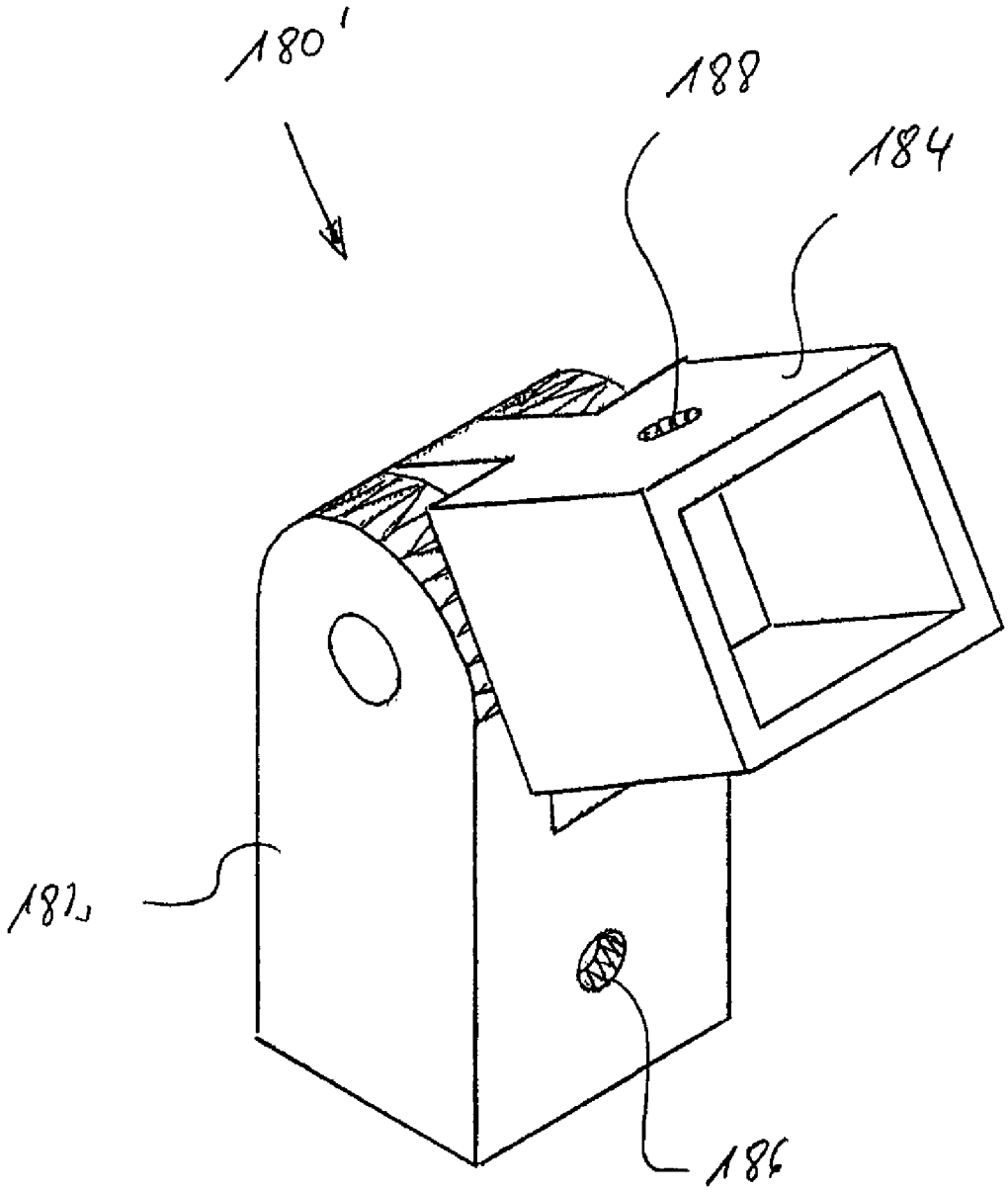
FIG. 5 shows in a perspective illustration a further embodiment of a connecting element provided with a joint for connecting two post sections.

FIG. 5 shows a further embodiment of a connecting element 180' having a joint. It corresponds substantially to the connecting element according to FIG. 4 so that same parts acting in the same way are provided with the same reference numerals. Accordingly, in regard to the description of the individual parts of the connecting element 180', reference is being had to the description of the connecting element 180 of FIG. 4.

Figure 6:
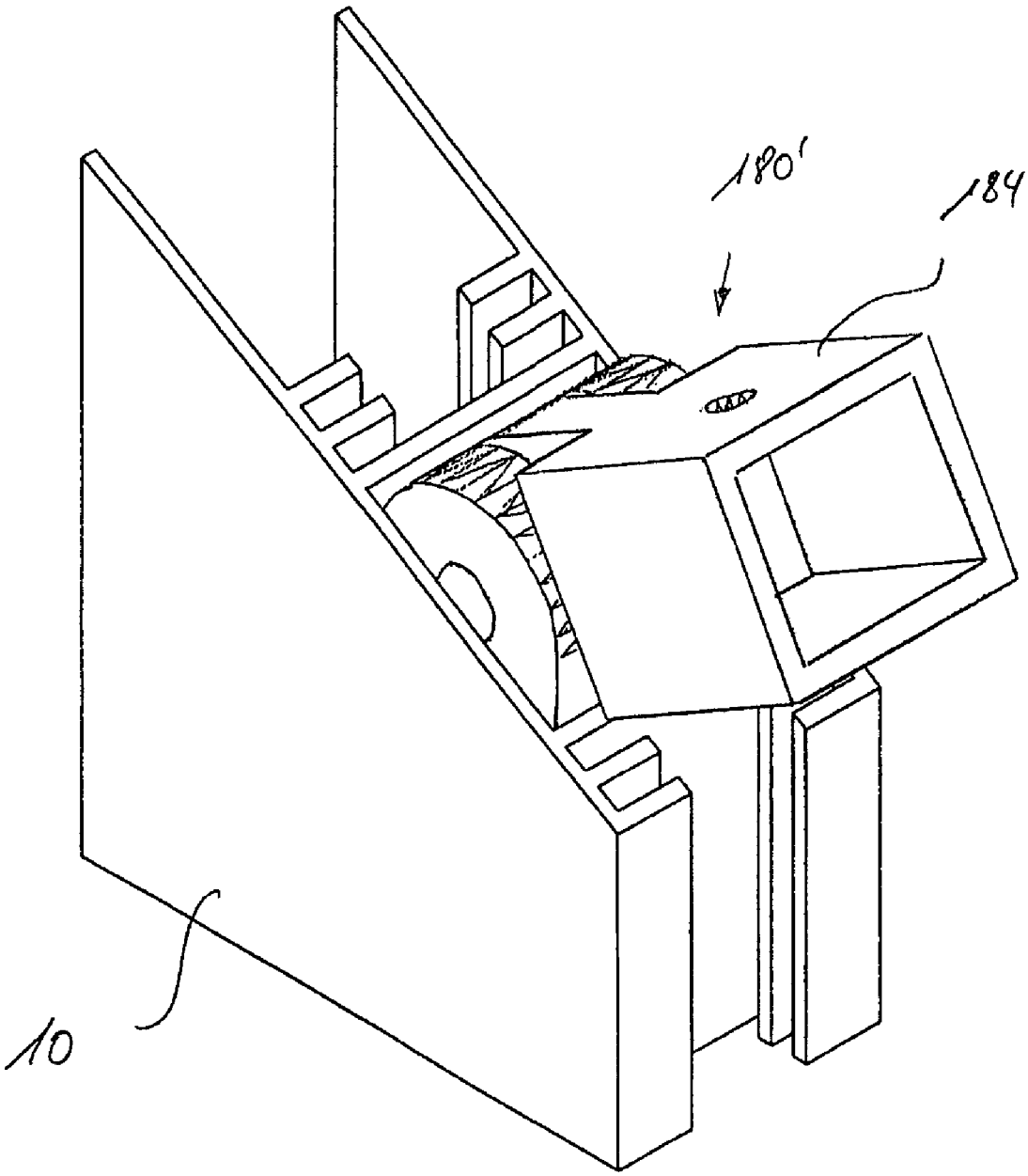
FIG. 6 shows in a perspective illustration a post section provided with a miter cut into which the connecting element according to FIG. 5 has been inserted.
Figure 7:
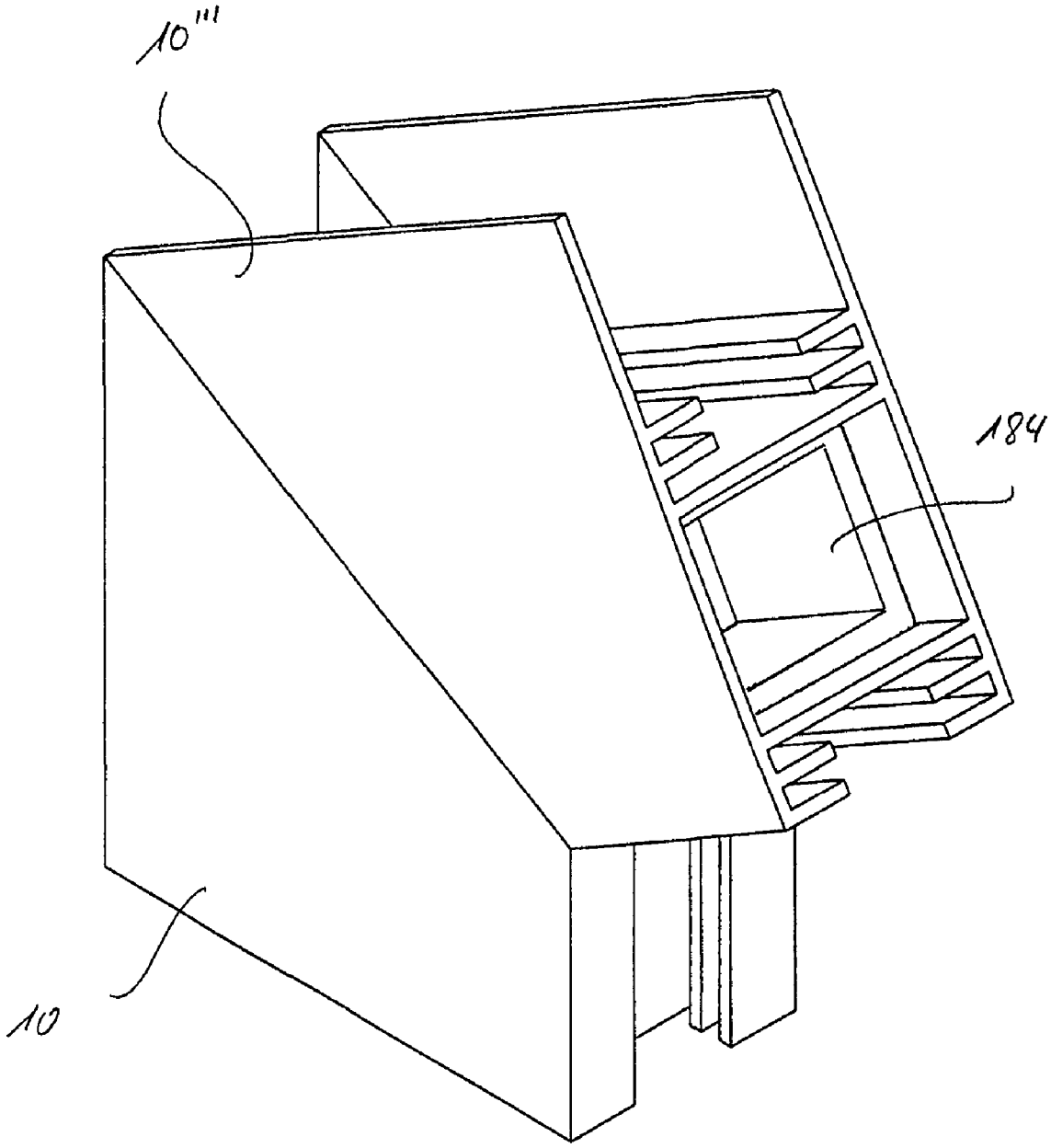
FIG. 7 shows a perspective illustration of two miter-cut post sections connected to one another by the connecting element according to FIG. 5.

In FIGS. 6 and 7, the use of the connecting element 180' for connecting to post sections 10 and 10''', which are miter-cut, is illustrated; the drawings are essentially self-explanatory. After insertion of the insertion sections 182 and 184 of the connecting element 180' into the post sections 10 and 10''', each post section is fixed in position relative to the connecting element, for example, in the way described in connection with FIG. 3 by an eccentric bolt, respectively.

Figure 8:
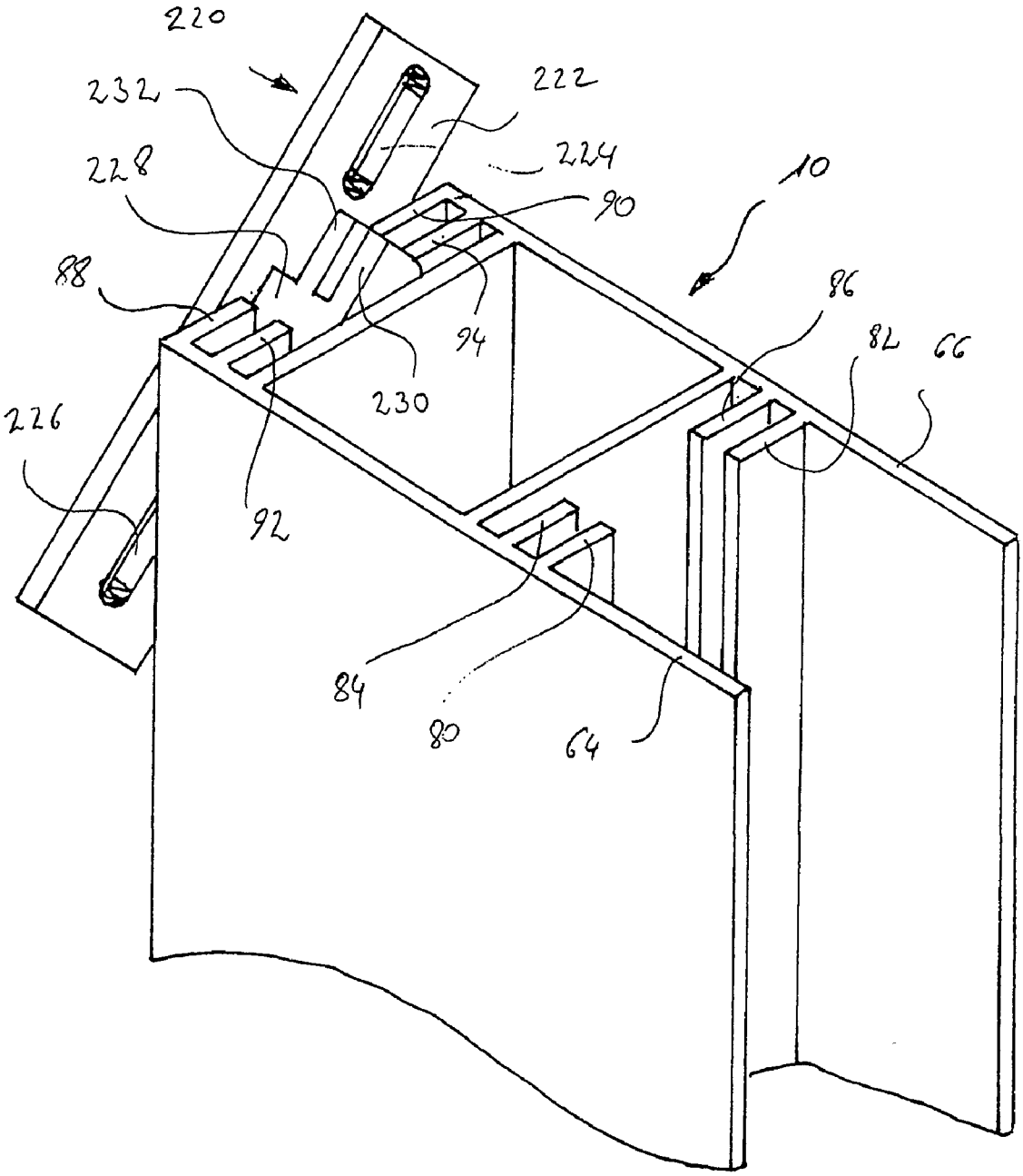
FIG. 8 is a perspective illustration of a post section and of a wall fastening element inserted partially into the corresponding section of the post section.

FIG. 8 shows a wall fastening element 220 and a post section 10.

The wall fastening element 220 is comprised in this embodiment of a contact leg 222, in which to slotted holes 224 and 226 are provided, as well as a locking portion 228 on which overall four wings are formed. FIG. 8 shows only the two wings 230 and 232.

At the point in time illustrated in FIG. 8, the wall fastening element 220 has just been inserted into the gap formed between the pairs of holding lips 88, 90, 92, 94 of the post section 10 and subsequently rotated by approximately 40 degrees so that the wings 230 and 232 are already engaging a holding lip 90 or 94. In the final mounted state the attachment element would be rotated by another 50 degrees so that after insertion of the locking portion 228 through the gap formed between the holding lips of the post section 10 it is rotated by approximately 90 degrees.

The post section 10 shown in FIG. 8 corresponds to the post section illustrated in FIG. 1 so that for describing the additional parts the post section reference is being had to the description of FIG. 1.

Figure 9:
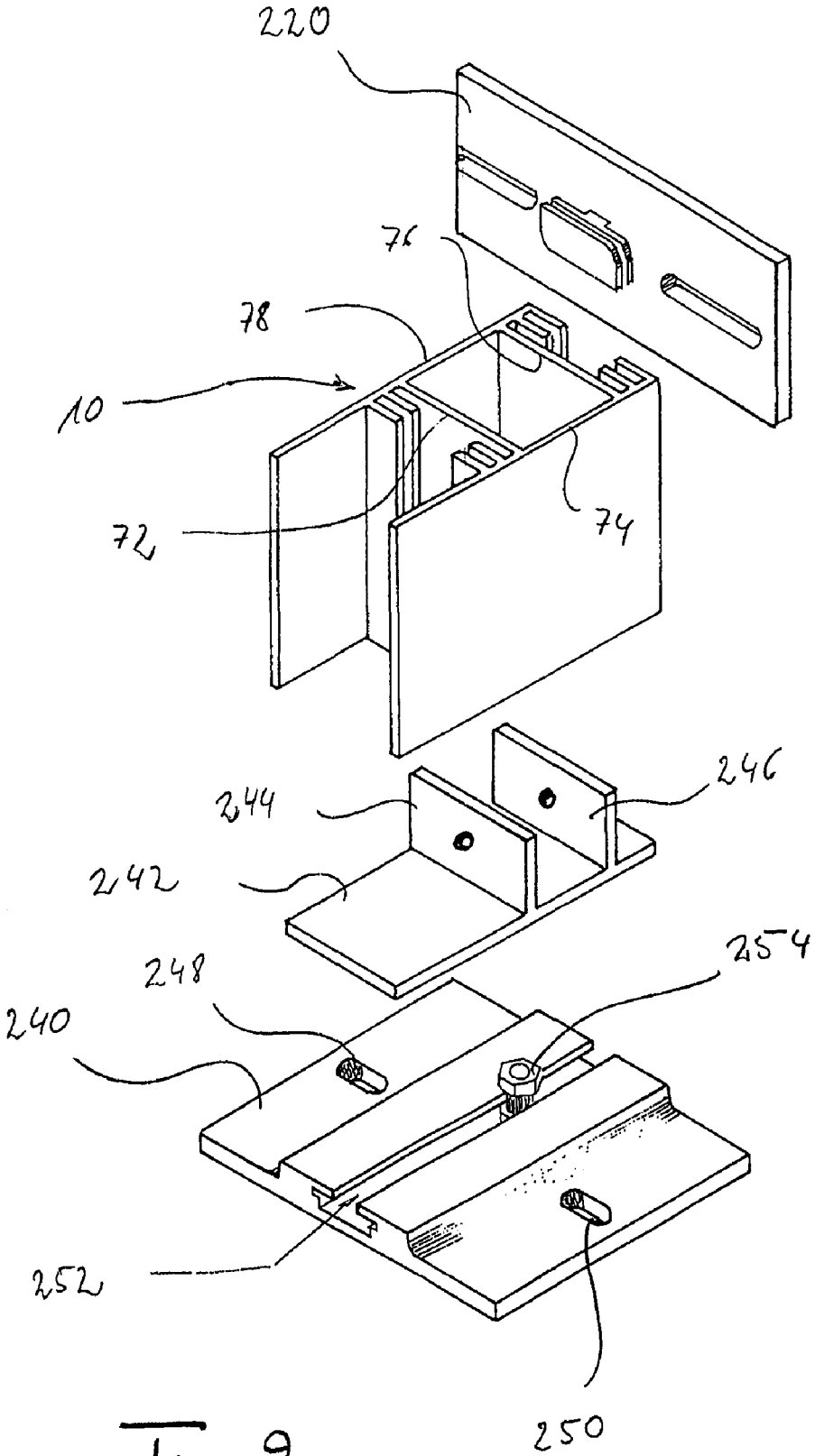
FIG. 9 is a perspective illustration of the individual elements for attachment of a post section on a wall and on the ground, in particular, a post section, a wall fastening element, as well as a two-part base member which is adjustable in several ways.

In FIG. 9 a post section 10 and different parts for attachment of the post section on the wall and on the ground are illustrated, i.e., the wall fastening element 220 already described in connection with FIG. 8 as well as a multi-part base member which is comprised essentially of the base plate 248 and the securing part 242.

The securing part 242 has profiled strips 2 44 and 246 extending essentially parallel to one another and sized such that they are partially complementary to the box formed by the profiled strips 72, 74, 76 and 78 of the post section 10 so that a post section 10 placed onto the securing part 242 can no longer be moved at least in two directions. As needed, a post section 10 placed onto the securing part 242 can be secured by means of a screw which is guided through the profiled strips 72 and 76 of the post section 10 and the profiled strips 244 and 246 of the securing part 242.

In the base plate 240, which is provided for fixation of the two-part base member and thus in the end of the post section 10 on the ground, two slotted holes 248 and 250 are provided so that the base plate 240 can later on still be moved to a certain extent and the entire construction can be aligned in this way.

In the base plate 240, an undercut groove 52 is provided also in which a securing screw 254 and, optionally a section provided possibly on the underside of the holding part 242 and configured to be partially complementary to the undercut groove, can be guided slidingly so that the base member comprised of the base plate 240 and the securing part 242 enables alignment of a poster section 10 to be secured therein in two directions that are independent from one another. When the correct position of the base plate 248 and the securing part 242 relative to one another has been determined, the base plate 240 and the holding plate 242 are fixed in position relative to one another by the securing screw 254.

In the case that the ground is uneven, two base plates can be arranged at a common height in that spacer elements are placed between one base plate and the ground.

In FIG. 10 two framed flat elements 260 and 262 are illustrated only schematically; they can be, for example, framed flat elements such as flat elements 24 and 26 according to FIG. 1.

In order to prevent that the flat elements 260 and 262 suspended on top one another along a holding section like the holding section illustrated in FIGS. 1 and 11 can be accidentally detached, between the two flat elements an elastic seal 264 is inserted. In this embodiment, it is secured by means of two separate profiled strips 266 and 268 in proper position. The seal 264 not only acts thermally insulating but also prevents that the flat element 262 suspended underneath the flat element 260 could be accidentally become detached (for example, when cleaning labor is performed) by being pushed unhindered in the direction toward the flat element 260.

The profiled strips 266 and 268 are matched in size and shape, on the one hand, to the profiling of the flat elements 260, 262 and, on the other hand, such that an elastic seal 264 pressed therebetween is secured safely in its position.

On the lower profiled strip 268 (in the proper mounted state) a groove 270 is formed which is slanted slightly toward the post sections extending in the mounted position to the left and to the right adjacent to the framed flat elements. The groove serves for draining rain water which will run down the flat element 268 arranged above to the post sections. In this way, it can be prevented that dirt particles on the flat elements that are removed by rain will reach the flat element arranged underneath so that the heavy soiling, in particular, of the lower flat elements, which is observed in constructions of the prior art is prevented.

In FIG. 11 the holding section 200, already described in connection with FIG. 1, is shown again in cross-section. It comprises a substantially U-shaped receptacle which is connected by means of two connecting stays 14 and 16 of material with minimal thermal conductivity to a fastening part 18, wherein the fasting part 18 serves for attaching the holding section 200 to the post section.

In the receptacle 12, two L-shaped sections 60 and 62 are formed such that two receiving channels 202 and 204 for receiving securing portions of a correspondingly shaped seal are provided.

On the fastening part 18 a projection 96 for supporting the holding section 200 on a holding lip of a post section as well as a leg 206 and an L-shaped section 208 are provided, wherein the leg 201 and the L-shaped section 208 form a substantially U-shaped section which can at least partially engage a holding lip of a post section.

Figure 12:
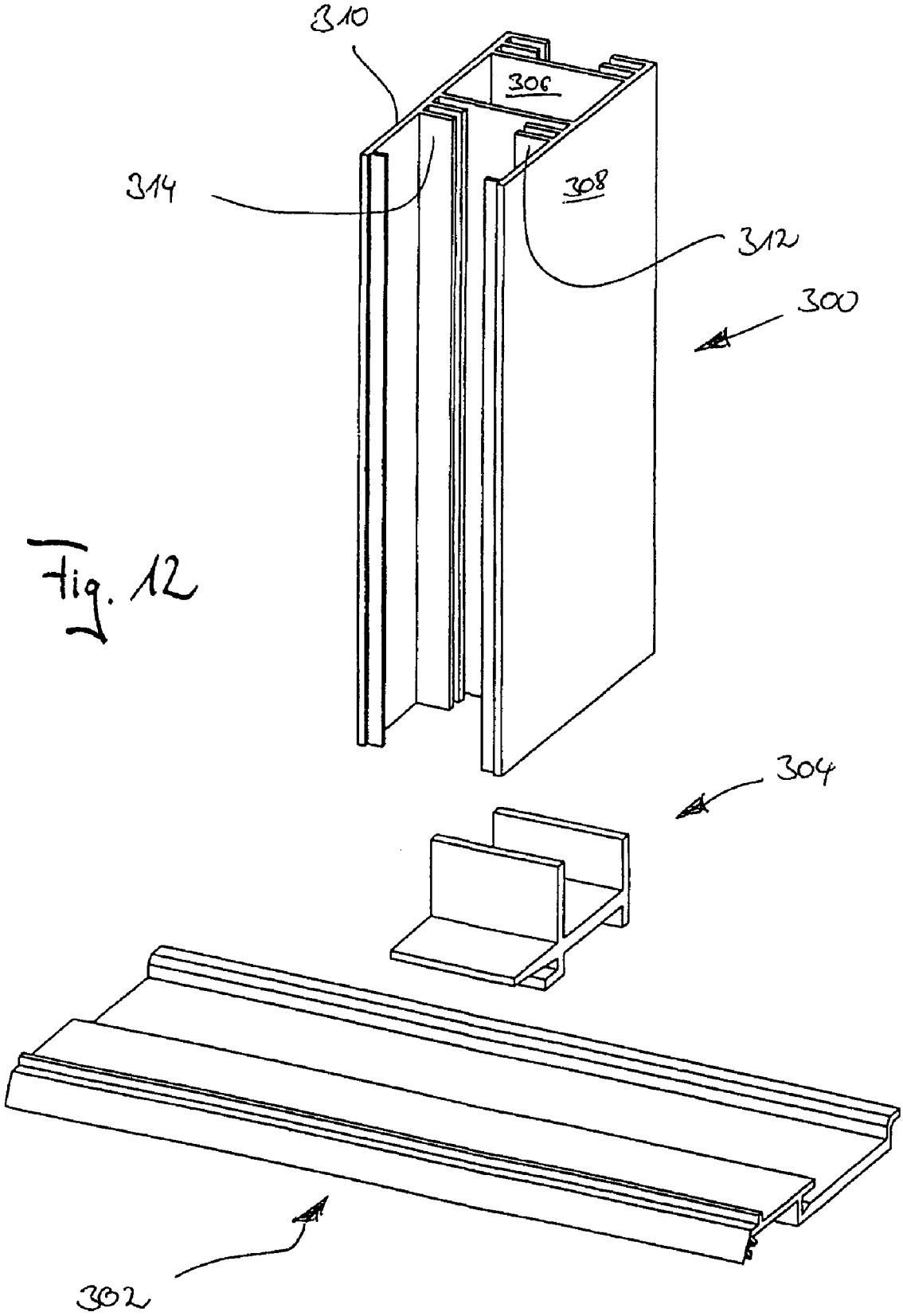
FIG. 12 is a perspective illustration of a post section, a bottom rail for ground attachment of the post section, and a securing part which serves for securing the post section on the bottom rail.

FIG. 12 shows a perspective illustration of a post section 300, a bottom rail 302 for attachment of the post section on the ground and a holding part 304 which serves for securing the post section on the bottom rail.

In this connection, the post section 300 is a box section with at least one rectangular box 306 in which on two parallel outer sides 308 and 310 at least two holding lips 312 and 314 for holding and securing holding sections and/or connecting members are provided.

Figure 13:
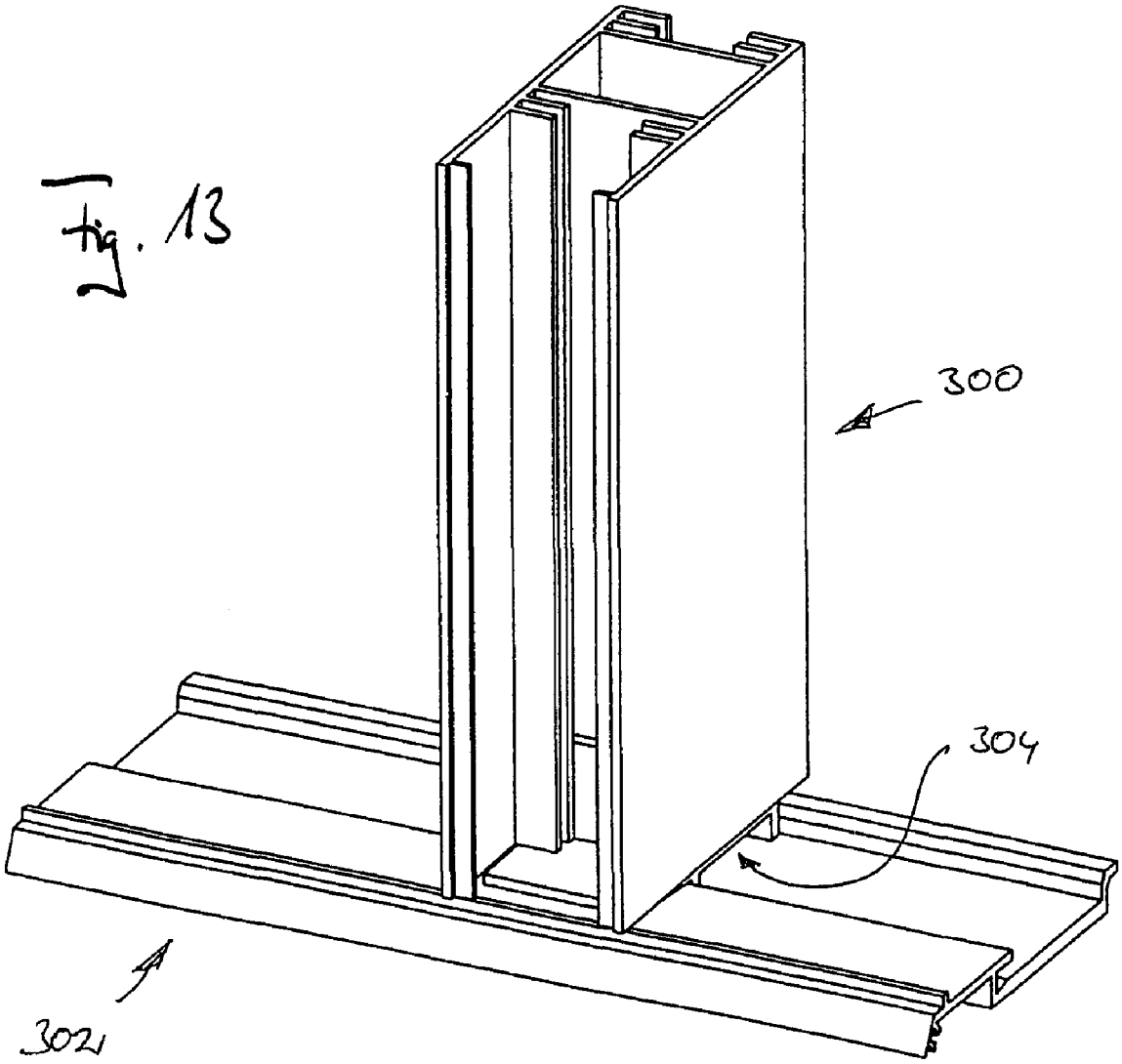
FIG. 13 is a perspective illustration of the three structural elements according to FIG. 12 in the mounted state.

In FIG. 13 a perspective illustration of three structural elements 300, 302, 304 according to FIG. 12 are shown in the mounted state.

Figure 14:
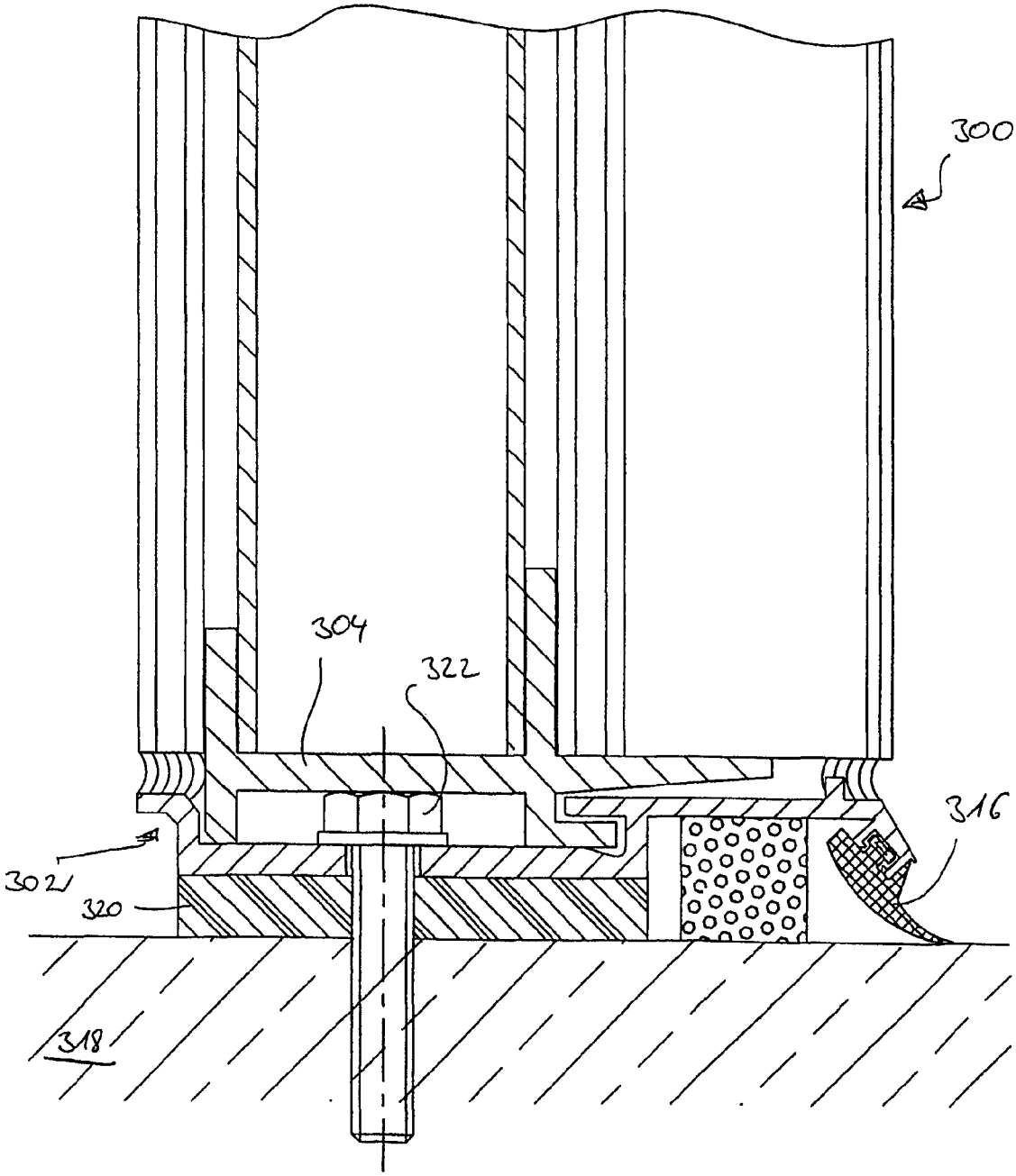
FIG. 14 is a cross-section of the mounted structural elements according to FIG. 13, viewed transversely to the extension of the bottom rail, wherein additional elements, not illustrated in FIG. 13, are shown, in particular, a sealing lip attached to the bottom rail, a spacer element for compensating different heights between the ground and the bottom rail inserted in the area of a post section, and a fastening screw screwed into the ground through the bottom rail for attachment of the bottom rail on the ground.

FIG. 14 shows a cross-section of the mounted components 300, 302, and 304 according to FIG. 13, viewed transversely to the extension of the bottom rail 302 wherein additional elements, not illustrated in FIG. 13, in particular a sealing lip 316 fastened on the bottom rail; a spacer elements 324 compensating different heights between the ground 318 and the bottom rail 300 and arranged in the area of the post section 300; and a fastening screw 322 screwed through the bottom rail 300 into the ground 318 for attachment of the bottom rail 300 to the ground 318.

Figure 15:
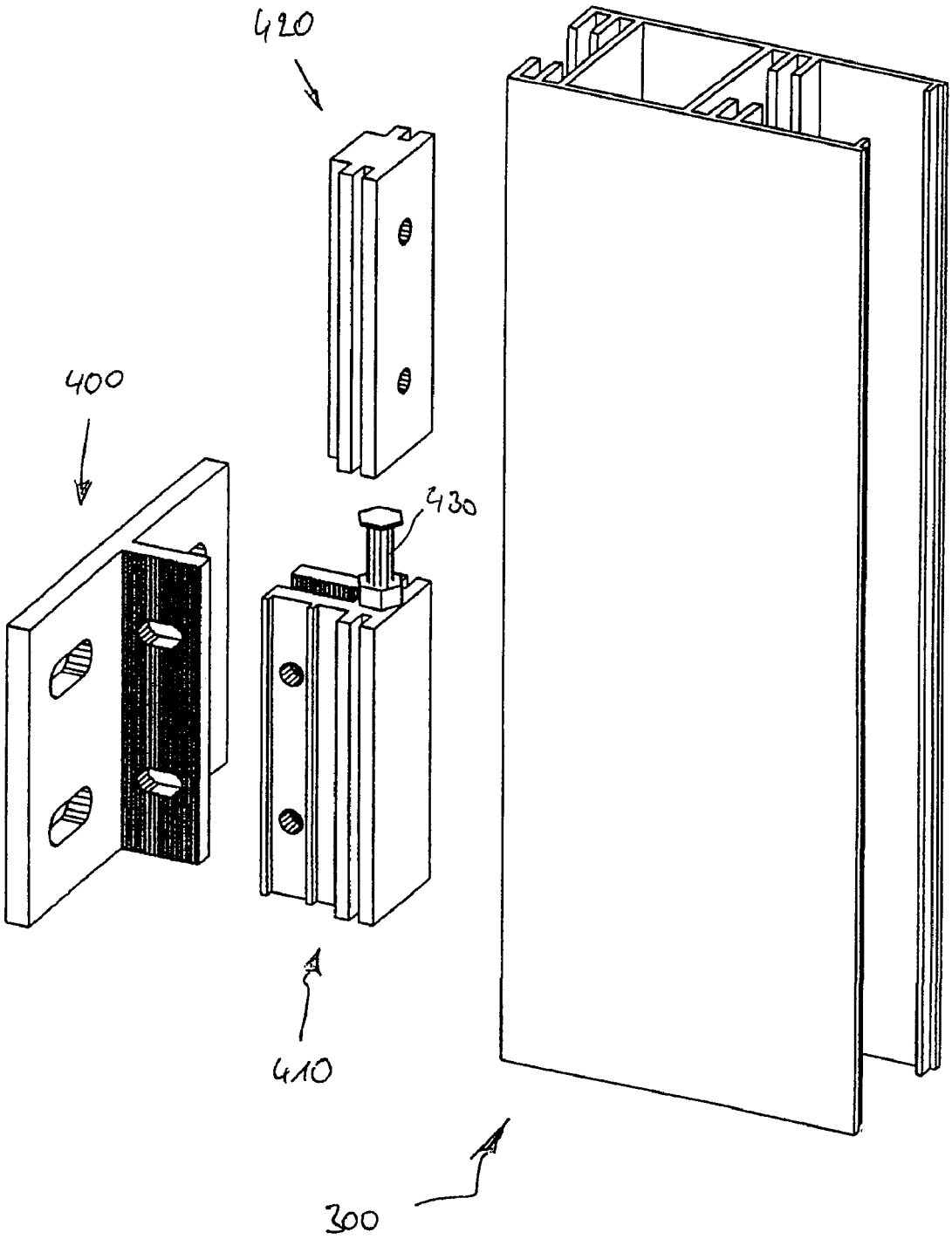
FIG. 15 is a perspective illustration of a post section, of a wall fastening element to be attached to a wall (not illustrated), a connecting member connecting the post section with the fastening element, and a fixation element which serves for securing a certain height of the post section relative to the connecting member.

FIG. 15 shows in a perspective illustration a post section; a wall fastening element 400, which is connected to a wall, not illustrated; a connecting member 410 which connects the post section 300 to the fastening element 400; and a fixation element 420 which serves for securing a predetermined height of the post section relative to the connecting member. In this connection, the fixation element 420 is connected fixedly to the post section 300.

For an exact height adjustment, an adjusting screw 430 is provided on the connecting member of 410.

Figure 16:
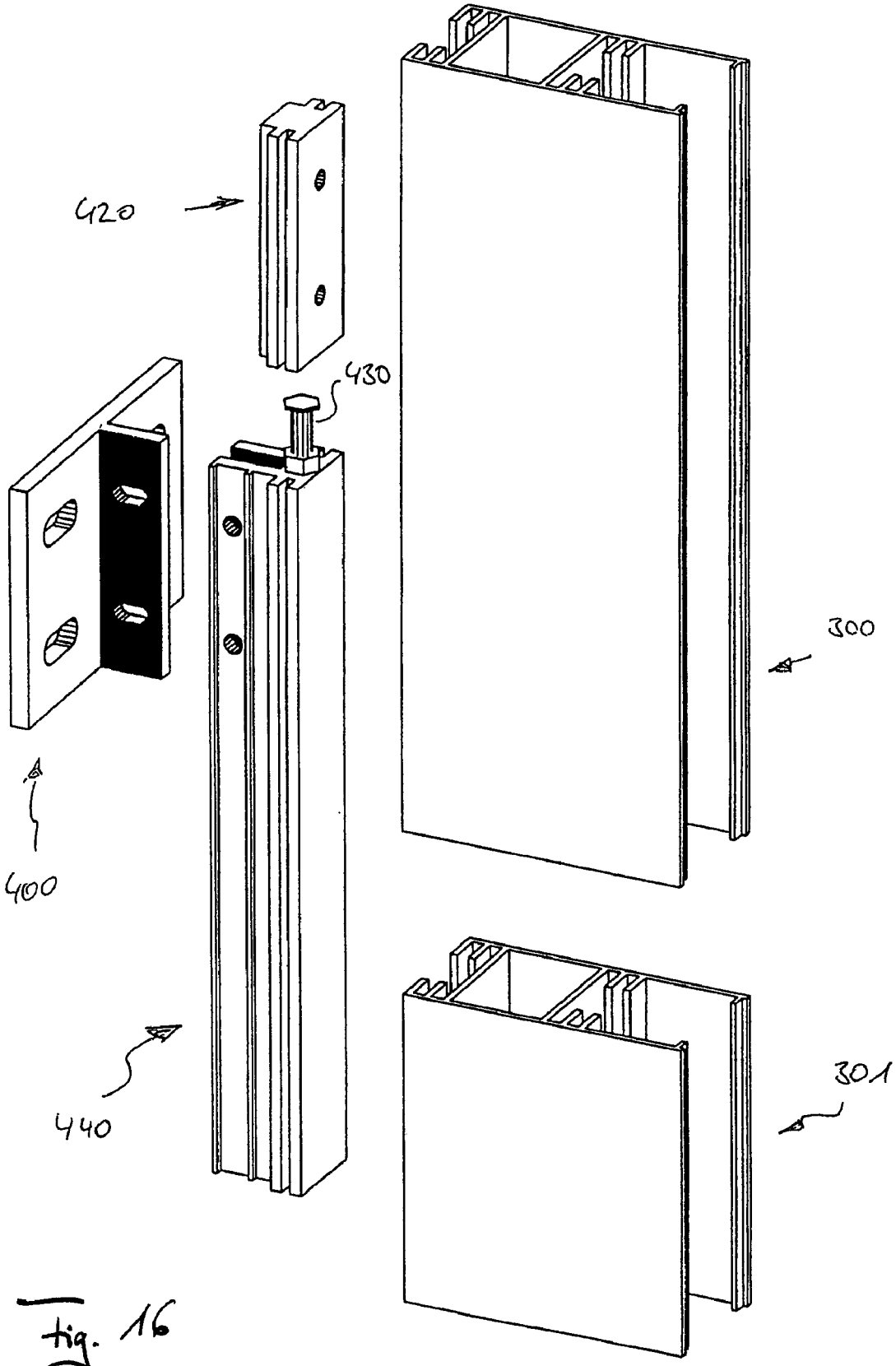
FIG. 16 shows a perspective illustration of different structural elements which corresponds substantially to the structural elements of FIG. 15, wherein, however, the connecting member is configured such that it extends across the abutting location of two post sections abutting in the longitudinal direction and in this way serves for aligning two post sections arranged in the longitudinal direction above one another.

FIG. 16 shows a perspective illustration of different structural elements 300, 301, 400, 420, and 440 which corresponds substantially to the structural elements of FIG. 4.

However, the connecting element 440 is configured such that it extends across the abutment location of two post sections 300 and 301 in the longitudinal direction and, in this way, serves simultaneously for aligning two post sections arranged above one another in the longitudinal direction.

Figure 17:
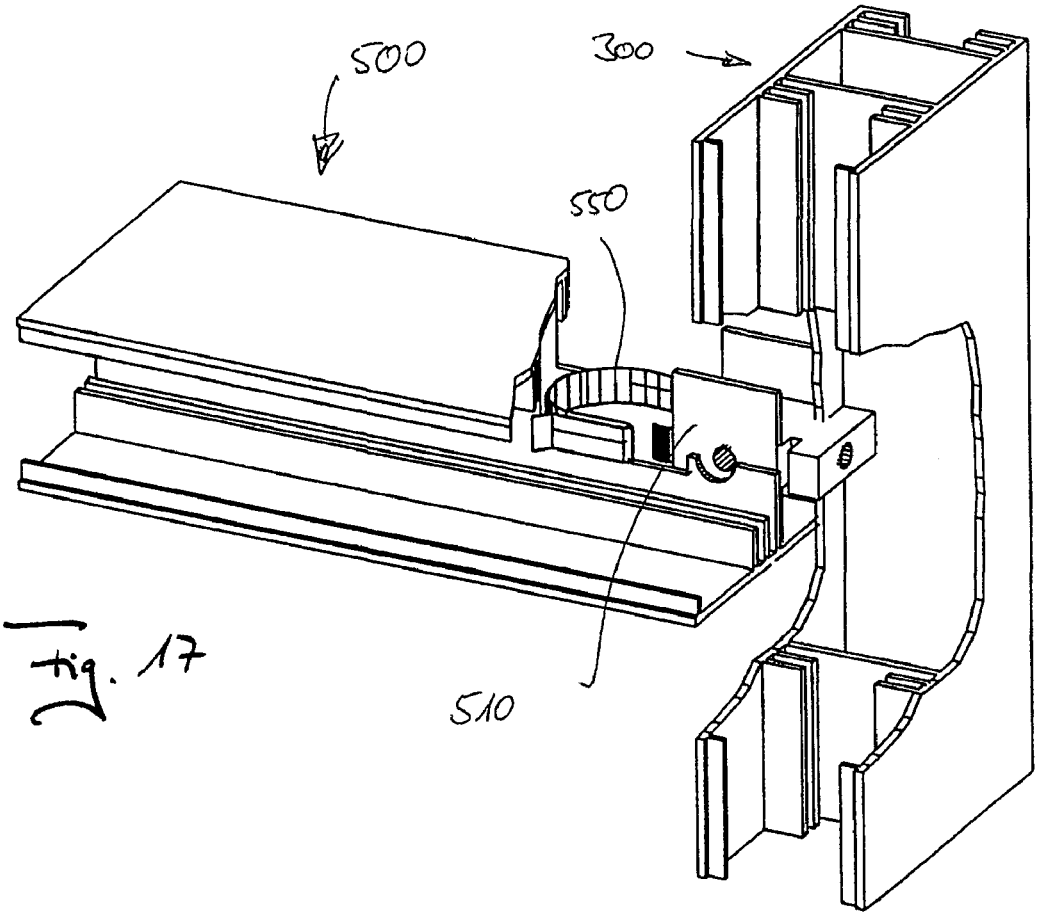
FIG. 17 shows a partially broken-away perspective illustration of two post sections which extend at a right angle relative to one another and are connected by means of a connecting element with one another, wherein the connecting element engages a T-shaped recess (not illustrated) provided in one of the post section and by means of a spring element is forced out of the other post section in the direction of the post section with the T-shaped recess.

FIG. 17 shows a partially broken-away perspective view of two post sections 500 which extend at a right angle to one another and are connected by means of a connecting element 510, wherein the connecting element 510 engages a T-shaped recess (not shown) in one of the post section 300 and is forced by means of a spring element 550 out of the other post section 500 in the direction to the post section 300 with the T-shaped recess.

Figure 18:
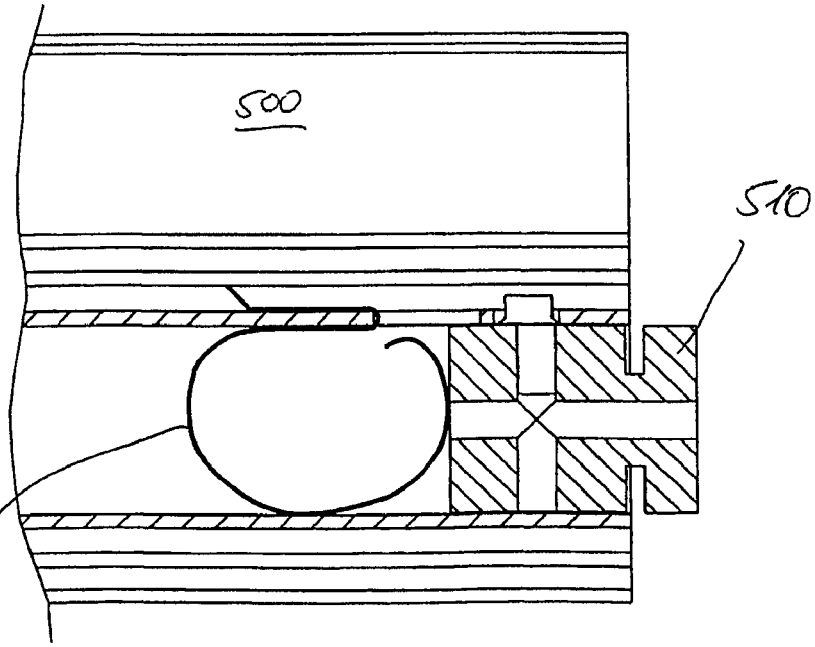
FIG. 18 is a section of the post section according to FIG. 17 which supports therein the spring element for pushing out the connecting element, showing the spring element and the connecting element.

FIG. 18 shows a section of the post section 500 according to FIG. 17 which supports therein the spring element for pushing out the connecting element 510; the spring element 550 and connecting element 510 are shown also.

Figures 19, 20:
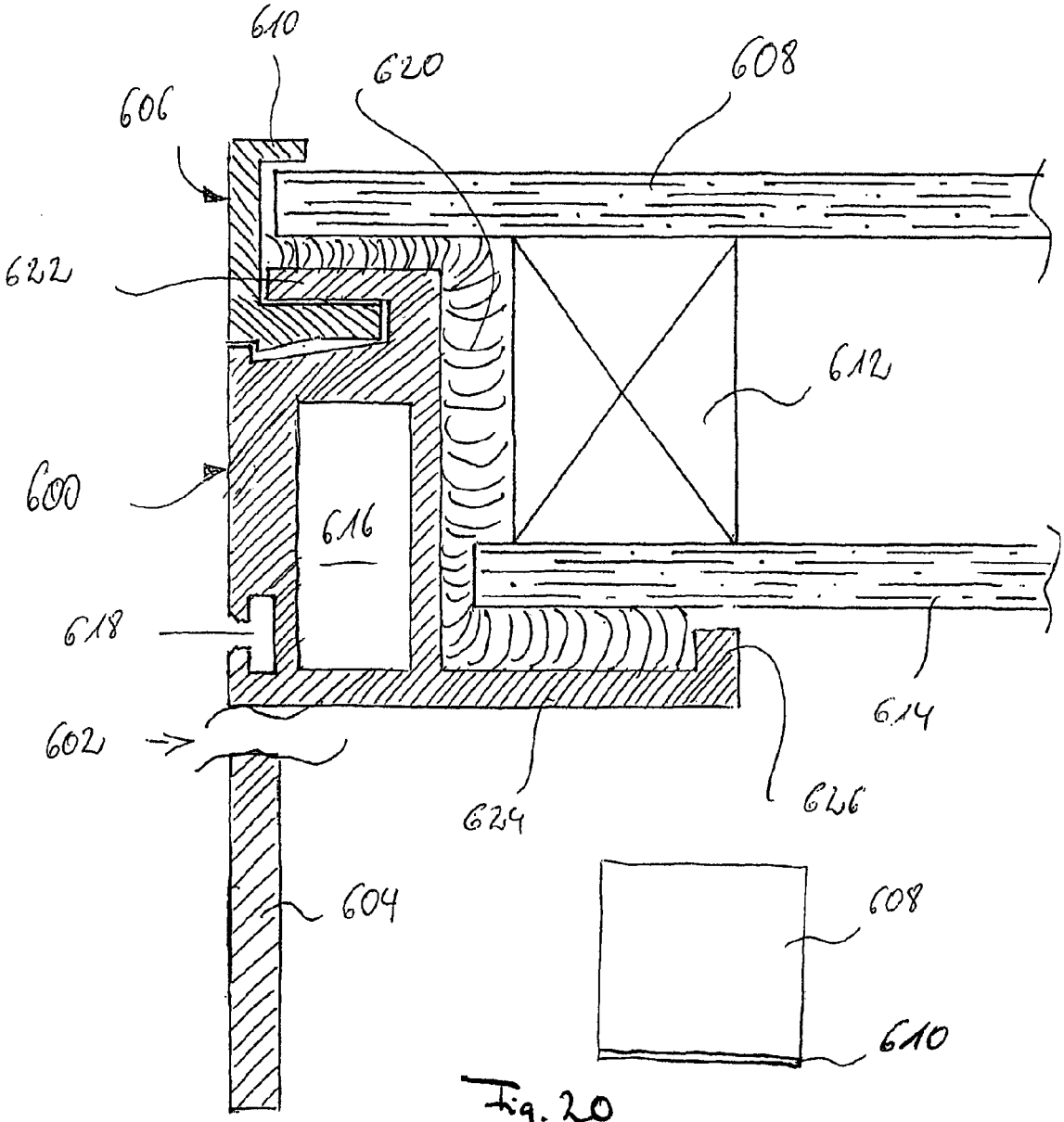
FIG. 19 is a schematic section of a detail of the edge area of a flat element framed according to the invention with two parallel glass panes and a frame section with snapped-on support section.
FIG. 20 is a schematic illustration of the framed flat element according to FIG. 19 viewed from the side forming the exterior of the building in the mounted state.

FIG. 19 shows of frame section 600. The interruption 602 indicates that the leg 604 is provided only on certain frame sections 600, i.e., on those that in the mounted state extend vertically, that is, on the right and left side of a framed flat element. The leg 604 has hook-shaped projections or recesses (not illustrated), with which the corresponding frame section and thus also the framed flat elements, for example, can be suspended from a corresponding post section. How this is effected is be explained, for example, in the aforementioned DE 101 23 463.5. The horizontal frame section, i.e. that frame section extending along the upper and lower edges of the framed flat element, do not require such a leg 604.

The frame section 600 has an undercut recess for a support section 606 which can be inserted with a leg that is partially complementary to the recess in such a way that it is locked therein. This is referred to as the support section 606 snapping into place on the frame section 600. In this connection, it is not necessary that on every frame section 600 such a support section 606 must be snapped into place; preferably, only the horizontally extending lower frame section in the mounted state of the framed flat elements on the facade or the like is provided with such a support section. FIG. 20 shows an outer view of flat element framed in this way of which, in a plan view, only the outer glass pane 608 and a narrow profiled strip 610 of the support section 606 can be seen, as is desired in the case of the aforementioned structural glazing.

Since windowpane 608 that is positioned usually at the exterior of the building is somewhat larger than the parallel extending windowpane 614 which is thermally separated (insulated) from the first one by the sealing element 612; it can be sized such (this is not illustrated in the drawing) that, on the three side which usually do not have a support section 606 snapped onto the frame section 600, it covers completely the frame section 600 in a plan view (this is the case when the support section is snapped into place only on one of the four frame sections 600 forming the basic frame for the windowpanes or the other elements to be framed, wherein, in principle, it is also possible to snap into place the support sections on two or more of the four frame sections forming the basic frame).

In the frame section 600 a hollow receptacle 616 for removing a known angular corner connection element is formed. Moreover, the frame section 600 has an undercut receptacle 618 for a seal which is provided usually along a frame section that extends horizontally in the mounted state.

The panes 608 and 614 or other elements to be framed are conventionally glued to the frame sections 600 in a way known in the art; this is indicated by the adhesive bead 620. It should be noted that in the schematic illustrations for the purpose of properly showing the individual components a certain spacing between the individual components is shown even though they can contact one another in practice.

The frame section 600 has two parallel legs 622 and 624 extending parallel to the elements to be framed, for example, to the panes 608 and 614. One leg (622) is a part of the receptacle for a portion of the support section 606 and at the same time provides a support for an element to be framed (In this case, the outer pane 608 with interposition of an adhesive 620), and the other leg (624) provides a support with interposition of adhesive 620 or a seal such as silicone for the other element to be framed (for the inner pane 614) and, moreover, has a profiled strip 626 which is angled relative to the element to be framed (here the panes 608 and 614) which also forms a boundary limitation for an injected adhesive or sealant.

The frame section 600 enables a high variability with respect to securing the elements to be framed without requiring a plurality of different components. Depending on the requirements on site, the support section 606 can be eliminated entirely so that, with a corresponding sizing of the elements to be framed, the frame construction is practically no longer visible in the mounted state. A single support section can be provided which generally extends along the lower framed profile in the mounted state; it is also possible that several support sections are snapped into place abut the elements to be framed on the frame sections, for example, at the top and at the bottom and/or to the left and right.

Industrial applications of the structural element system and of its structural elements are apparent. It should be noted in this context that the invention provides a new business concept for quickly and thus inexpensively erecting curtain facades, facade linings, transparent roofs, sunrooms, soundproofing walls, fair buildings, carports and the like. This method is therefore considered part of the invention.

In the context of the present invention numerous modifications and developments are possible, for example, in regard to the type and configuration of the individual structural elements of the system. An important idea of the invention is the improved thermal separation (insulation) of the framed flat elements and post sections by interposition of separate holding sections, in particular, such holding sections which themselves have a thermal separation (thermal insulation).

While specific embodiments of the invention have been shown and described in detail to illustrate the inventive principles, it will be understood that the invention may be embodied otherwise without departing from such principles.

What is claimed is:

1. A structural element system for floatingly suspending framed flat elements in the construction industry, the structural element system comprising:

post sections;

framed flat elements;

holding sections;

seals;

wherein, for thermally insulating the post sections from the framed flat elements, the holding sections are attached on the post sections, the framed flat elements are attached to the holding sections, the seals are adapted to form together with the post sections chambers for enclosing the holding sections, in the mounted state of the structural element system, the holding sections are enclosed in the chambers so that the holding elements have no direct contact with the framed flat elements;

wherein each one of the holding sections is of a multi-part configuration and in cross-section have a substantially U-shaped receptacle for receiving a frame section of the framed flat elements and a fastening part for attaching the holding section on the post section, wherein the receptacle and the fastening part are connected to one another by at least one stay of a material having minimal thermal conductivity.

2. The structural element system according to claim 1, wherein the post section is a box section having at least one rectangular box for securing the holding sections, respectively, wherein the rectangular box has on two parallel outer sides at least two holding lips configured to secure the holding sections and/or a connecting member.

3. The structural element system according to claim 1, wherein each one of the post sections is a box section having at least one rectangular box, wherein the rectangular box has on two parallel outer sides at least two holding lips configured to secure holding sections, connecting members, wall fastening elements, and cover strips.

4. The structural element system according to claim 3, wherein on at least one of the outer sides on which holding lips are formed two parallel pairs of the holding lips are provided.

5. The structural element system according to claim 1, wherein the receptacle and the fastening part are connected to one another by two of the stays that are parallel to one another and made of plastic material.

6. The structural element system according to claim 1, wherein the fastening part is configured such that the holding section is inserted laterally into an opening of the post section formed between a pair of holding lips formed on the post section and forms with the post section a partially positive-locking connection.

7. The structural element system according to claim 6, wherein the fastening part has a substantially U-shaped section for partially engaging a holding lip of a pair of holding lips formed on the post section and further has a projection for supporting the holding section on the other holding lip of the pair of holding lips.

8. The structural element system according to claim 1, wherein, along the receptacle transversely to its longitudinal extension, at certain distances holding bolts are inserted or receptacles for the holding bolts are provided where matchingly shaped framed flat elements are suspended.

9. The structural element system according to claim 1, wherein the receptacle has two preferably undercut receiving channels for receiving securing portions of a seal insertable into the receptacle, wherein the securing portions are at least partially complementary to the receiving channels.

10. The structural element system according to claim 1, comprising a fastening element that has a contact leg for attaching the fastening element to a wall, a base member, or a carrier and a support leg projecting at a right angle from the contact leg for supporting a connecting member.

11. The structural element system according to claim 10, wherein the contact leg of the fastening element has slotted holes for receiving fastening screws.

12. The structural element system according to claim 1, further comprising a connecting member for attaching post sections having holding lips to a fastening element, wherein the connecting member has a saddle section placed onto a support leg of the fastening element and a locking section with at least two wings for engaging from behind the holding lips of a post section.

13. The structural element system according to claim 12, wherein the connecting member comprises a support leg to be inserted into the receiving section of the fastening element.

14. The structural element system according to claim 12, wherein the locking section of the connecting member has four wings for engaging behind the holding lips of a post section to be fastened having two pairs of parallel holding lips.

15. The structural element system according to claim 12, wherein the locking section of the connecting member is formed such that the wings are moved through a gap formed between a pair of holding lips of the post section to be fastened and moved by relative rotation of the connecting member and the post section into a position behind the holding lips.

16. The structural element system according to claim 15, wherein at least one of the wings has a stop surface provided for limiting the relative rotation of the connecting member and the post section.

17. The structural element system according to claim 1, further comprising a connecting member adapted for connecting two post sections having a hollow chamber, wherein the connecting member has a first insertion section, insertable into the chamber of the first post section and having a cross-section matching a cross section of the hollow chamber, and a second insertion section, connectable in any desired way to the second post section, wherein the first and second insertion sections are connected by a joint; wherein the first insertion section has at least one receiving bore for an eccentric fastener for clamping and securing the first post section.

18. The structural element system according to claim 17, wherein the second insertion section is configured to be inserted into a T-shaped receiving opening of the second post section.

19. The structural element system according to claim 17, further comprising an eccentric fastener having a guide section insertable into receiving bore of the connecting element, and having a preferably conical eccentric section for providing a clamping force between the first insertion section and the first post section.

20. The structural element system according to claim 1, further comprising a two-part profiled frame for the framed flat element, the two-part profiled frame comprising:

outer frame sections for engaging an outwardly facing side of flat element in a mounted state;

an inner frame section for engaging an inwardly facing side of the flat element in a mounted state;

wherein the outer and inner frame sections are locked with one another;

wherein the flat element to be framed is clamped between the outer and the inner frame sections;

wherein at least on one of the outer frame sections means are provided for attaching the frame sections on a post section or a holding section.

21. The structural element system according to claim 20, wherein the means for attaching the outer frame sections comprise hooks formed on a leg of the outer frame section or receiving opening on a leg of the outer frame sections, in particular, for suspending the framed flat elements on a holding bolt in a receptacle of a holding section.

22. The structural element system according to claim 1, further comprising a seal that has a channel with two sidewalls insertable into a U-shaped receptacle of the holding section and wherein an open end of the channel is provided on each side wall with a sealing lip, respectively, angled toward the outer side of the channel.

23. The structural element system according to claim 22, wherein the sealing lips are provided on a side facing in the mounted state the post section with support beams for supporting the holding section on the post section.

24. The structural element system according to claim 22, wherein the sealing lips on the side facing the holding section have a securing portion having a shape that is at least partially complementary to a receiving channel of the holding section.

25. The structural element system according to claim 1, further comprising a wall fastening element adapted for attaching post sections having holding lips, the wall fastening element comprising a contact leg for attaching the wall fastening elements on a support surface and a locking section projecting at a right angle from the contact leg and having at least two wings for engaging from behind the holding lips of the post section.

26. The structural element system according to claim 1, further comprising a base member comprising a base plate for attachment of the base member on the ground and a securing part for securing a post section, wherein the base plate and the securing plate are configured such that alignment of a post section secured therein in at least two independent directions is enabled, wherein the base plate has at least two slotted holes and an undercut groove, wherein in the undercut groove at least one of a securing screw and the securing part are moveable slidingly.

27. The structural element system according to claim 1, further comprising bottom rails for a ground attachment of the post sections and the holding parts for securing the post sections on the bottom rail.

28. The structural element system according to claim 1, further comprising:

wall fastening elements for attaching the structural element system to a wall;

connecting members for connecting the post sections to the wall fastening elements;

and fixation elements for securing a height of the post sections relative to the connecting member.

29. The structural element system according to claim 1, further comprising:

connecting elements for connecting two of the post sections preferably at a right angle to one another;

wherein the connecting elements engage a T-shaped recess in a first post section and, by means of a spring element can be forced out of the second post section in the direction toward the first post section.

30. A structural element system for floatingly suspending framed flat elements in the construction industry, the structural element system comprising:

post sections;

framed flat elements;

holding sections;

seals;

wherein, for thermally insulating the post sections from the framed flat elements, the holding sections are attached on the post sections, the framed flat elements are attached to the holding sections, the seals are adapted to form together with the post sections chambers for enclosing the holding sections, in the mounted state of the structural element system, the holding sections are enclosed in the chambers so that the holding elements have no direct contact with the framed flat elements;

wherein each one of the post sections is a box section having at least one rectangular box, wherein the rectangular box has on two parallel outer sides at least two holding lips configured to secure holding sections, connecting members, wall fastening elements, and cover strips;

wherein on one of the outer side provided with the holding lips two parallel legs are provided for at least partially enclosing a holding section;

wherein the parallel legs have an inner side facing in the mounted state the holding section that is coated with a thermal insulation, in particular with strips of sponge rubber, chloroprene, or cork.

31. The structural element system according to claim 30, having a recess configured to suspend a connecting element.

32. The structural element system according to claim 31, wherein the recess is substantially T-shaped.

33. A structural element system floatingly suspending framed flat elements in the construction industry, the structural element system comprising:

post sections;

framed flat elements;

holding sections;

seals;

wherein, for thermally insulating the post sections from the framed flat elements, the holding sections are attached on the post sections, the framed flat elements are attached to the holding sections, the seals are adapted to form together with the post sections chambers for enclosing the holding sections, in the mounted state of the structural element system, the holding sections are enclosed in the chambers so that the holding elements have no direct contact with the framed flat elements;

bottom rails for a ground attachment of the post sections and the holding parts for securing the post sections on the bottom rail;

sealing lips and spacer elements attachable to the bottom rail for compensating different spacings between the ground and the bottom rail.

34. A frame section for a structural element system for the construction industry, the structural element system comprising post sections; framed flat elements; holding sections; seals; wherein, for thermal insulation of the post sections and the framed flat elements, the holding sections are attached on the post sections; the framed flat elements are attached to the holding sections; the seals together with the post sections form chambers; and, in the mounted state of the structural element system, the the holding sections are enclosed in the chambers; the frame section comprising:

two parallel extending legs extending parallel to the flat elements to be framed;

wherein a first one of the parallel extending legs has a profiled strip angled toward the flat elements to be framed.

35. The frame section according to claim 34, comprising a receptacle for a corner connection element.

36. The frame section according to claim 34, comprising a receptacle for a seal.

37. The frame section according to claim 34, comprising a recess for a support section configured, in particular undercut, such that the matching support section forms a snap connection with the frame section.

38. The frame section according to claim 37, wherein one of the legs comprises a hook-shaped projection or recess for suspension of the frame section in particular from the post section.

* * * * *